US008893798B2

(12) United States Patent
Hayter et al.

(10) Patent No.: US 8,893,798 B2
(45) Date of Patent: Nov. 25, 2014

(54) BARRIER VALVE HYDRAULIC OPERATOR WITH COMPOUND VALVE OPENING FORCE FEATURE

(75) Inventors: Steven R. Hayter, Houston, TX (US); Brad R. Pickle, Frisco, TX (US); Antonio D. Lazo, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 756 days.

(21) Appl. No.: 12/899,237

(22) Filed: Oct. 6, 2010

(65) Prior Publication Data

US 2012/0085542 A1 Apr. 12, 2012

(51) Int. Cl.

| | |
|---|---|
| ***E21B 34/10*** | (2006.01) |
| ***E21B 34/14*** | (2006.01) |
| ***E21B 23/04*** | (2006.01) |
| ***E21B 23/00*** | (2006.01) |

(52) U.S. Cl.

CPC ..... *E21B 23/006* (2013.01); *E21B 23/04* (2013.01)

USPC ..... 166/331; 166/332.1; 166/332.3; 166/334.2

(58) Field of Classification Search

USPC ..... 166/373, 374, 381, 386, 331, 332.2, 166/332.3, 334.2, 332.1

See application file for complete search history.

(56) References Cited

U.S. PATENT DOCUMENTS

| | | | | |
|---|---|---|---|---|
| 3,865,141 | A | 2/1975 | Young | |
| 5,484,022 | A * | 1/1996 | Coutts et al. | 166/336 |
| 5,549,161 | A | 8/1996 | Gomez et al. | |
| 5,810,087 | A | 9/1998 | Patel | |
| 5,950,733 | A | 9/1999 | Patel | |
| 6,230,807 | B1 | 5/2001 | Patel | |
| 6,352,119 | B1 | 3/2002 | Patel | |
| 6,662,877 | B2 * | 12/2003 | Patel | 166/386 |
| 7,210,534 | B2 | 5/2007 | Hayter et al. | |
| 7,303,020 | B2 * | 12/2007 | Bishop et al. | 166/374 |
| 7,503,390 | B2 | 3/2009 | Gomez | |
| 7,556,102 | B2 | 7/2009 | Gomez | |
| 7,594,542 | B2 | 9/2009 | Loretz et al. | |
| 2008/0023193 | A1 | 1/2008 | O'Brien | |

* cited by examiner

*Primary Examiner* — Robert E Fuller
(74) *Attorney, Agent, or Firm* — Steve Rosenblatt

(57) ABSTRACT

A housing can be mounted adjacent an isolation valve and after a fixed number of on and off pressure cycles allow a spring to push an actuator to operate the valve to an open position. The actuator, can be reset with a tool run into the module to move the actuator back against a power spring and hold that spring force until the pressure cycling begins again. The preferred application is for a formation isolation ball valve but other valves, such as sliding sleeves, or other types of downhole tools can be actuated with the module that permits a retrofit of a hydraulic operation to a heretofore purely mechanically actuated tool. The actuation force to initially open is boosted by a secondary potential energy source that is unlocked to give an initial boost force to the indexing spring that is part of a j-slot actuation mechanism.

20 Claims, 28 Drawing Sheets

BARRIER VALVE HYDRAULIC OPERATOR WITH COMPOUND VALVE OPENING FORCE FEATURE

FIELD OF THE INVENTION

The field of the invention is a modular hydraulic assembly that can be coupled to an otherwise mechanically operated tool and preferably a valve to allow the option of hydraulically opening the tool or valve once or multiple times. More particularly, the assembly further allows the release of a stored force for a boost force upon initial opening of the valve.

BACKGROUND OF THE INVENTION

Different valve styles have been used downhole. One type is a sliding sleeve valve that can selectively cover or open holes in a casing or liner string. These valves are typically shifted with a shifting tool that grabs a recess in the sleeve and pulls or pushes the sleeve to open or close the wall ports in the tubular. Some examples are U.S. Pat. Nos. 5,549,161; 7,556,102 and 7,503,390.

Formation isolation valves have been used that have a ball that is attached to a sleeve so that movement of the sleeve results in ball rotation between open and closed position. These valves typically included a piston responsive to tubing pressure that worked in conjunction with a j-slot mechanism. The valve was closed mechanically but could be opened once with a predetermined number of pressure cycles on the piston. Eventually, a long slot in the j-slot would be reached to allow a spring or a compressed gas reservoir to move an operating sleeve into another sleeve that was attached to the ball so that the ball could be rotated to the open position. In one design the ball was locked after moving into the open position but that lock could be overcome with another tool run downhole. There was also a provision for an emergency opening with a pressure tool if for some reason the pressure cycles failed to open the ball. This design is illustrated in U.S. Pat. No. 7,210,534. Other formation isolation valves that came as an assembly of a mechanically operated ball that had the option of opening with pressure cycles until a j-slot allowed a pressurized chamber charged to a known specific pressure to move an operating sleeve against another sleeve to get the ball to turn open are illustrated in U.S. Pat. Nos. 5,810,087 and 6,230,807 while U.S. Pat. No. 5,950,733 initiates opening the ball with pressure that breaks a rupture disc to liberate pressure previously stored to move a sleeve to open that valve.

These combination valves with the hydraulic open feature bundled into a mechanical valve such as a ball valve are very expensive and in many applications represent overkill because a manually operated barrier valve such as with a shifting tool run in on coiled tubing, for example would be sufficient and within the budget for the particular project. On the other hand, the specification for some projects changes where the previously ordered manual barrier valve is determined to be insufficient for the application without a hydraulic opening feature. A hydraulically operated module of the present invention addresses this need for flexibility and further makes it possible for use of the module on a variety of tools when those tools can respond to shifting of an operating rod. The hydraulic module further incorporates either a one-time only configuration which is the simpler variation or another variation that can be re-cocked after an actuation with a tool run in from the surface to move the operating piston back up. The unique configuration of the cycling control assembly allows the ability to re-cock with minimal displacement of the operating rod so that the tool can be shorter because the operating rod does not need to be displaced after the valve opens any further than it takes to land a snap ring back in a groove so that the series of pressure cycles can resume when another hydraulic opening of the valve is required. The above system was described in detail in a commonly assigned application in the U.S. having Ser. No. 12/618,123 and filed on Nov. 13, 2009, entitled Modular Hydraulic Operator for a Subterranean Tool and whose contents are incorporated by reference herein as though fully set forth.

In another aspect, a backup potential energy source is provided that provides a force assist when trying to crack the valve open against high pressure differentials where an initial force to turn a ball toward open can be in the order of thousands of pounds of force. This auxiliary force is retained isolated during the predetermined pressure cycles that do not release the auxiliary force until the pressure is released on a predetermined cycle so that the boost force is initially applicable as the valve begins to open while the remainder of the movement is accomplished with the indexing spring. Variations that are one time operation or resettable with a tool are described.

These and other advantages of the present invention will become more apparent to those skilled in the art from a review of the description of the preferred embodiment and the associated drawings while recognizing that the full scope of the invention is given by the appended claims.

SUMMARY OF THE INVENTION

A modular pressure operated actuator can be coupled with a downhole tool to selectively operate it at least once. In the preferred embodiment the module can be mounted adjacent an isolation valve and after a fixed number of on and off pressure cycles allow a spring to push an actuator to operate the valve to an open position. The actuator, in another embodiment, can be reset with a tool run into the module to move the actuator back against a power spring and hold that spring force until the pressure cycling begins again. The preferred application is for a formation isolation ball valve but other valves, such as sliding sleeves, or other types of downhole tools can be actuated with the module that permits a retrofit of a hydraulic operation to a heretofore purely mechanically actuated tool. The actuation force to initially open is boosted by a secondary potential energy source that is unlocked to give an initial boost force to the indexing spring that is part of a j-slot actuation mechanism.

DETAILED DESCRIPTION OF THE PREFERRED EMBODIMENT

Figure 1:
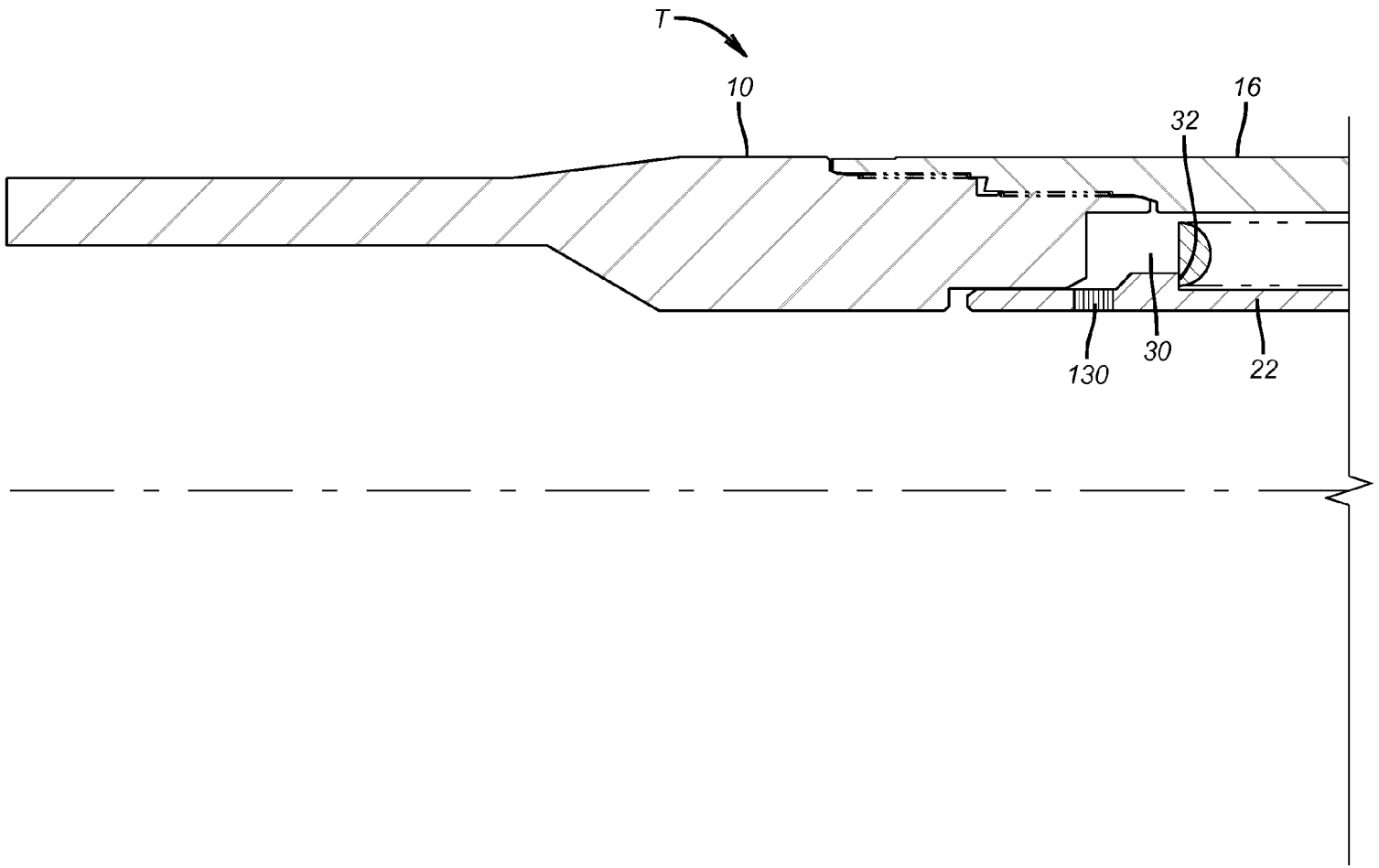
FIGS. 1-6 are a section view of the tool showing it in its position with tubing pressure reduced and against a lower travel stop.

Referring to FIGS. 1-6 the modular tool T starts at a top sub 10 and ends at a bottom sub 12. The top sub 10 is connected to a tubing string that is not shown. The tool being operated that is also not shown is connected at thread 14 on the bottom sub 12. In between subs 10 and 12 are spring housing 16, cylinder sub 18 (shown in full section rather than the half section of the other outer components) and main housing 20. Interiorly there is a vented spring mandrel 22 connected between the top sub 10 and the cylinder sub 18. There is also an indexing mandrel 24 between the cylinder sub 18 and the bottom sub 12. A through passage 26 runs through the tool T from top sub 10 to bottom sub 12.

Figure 2:
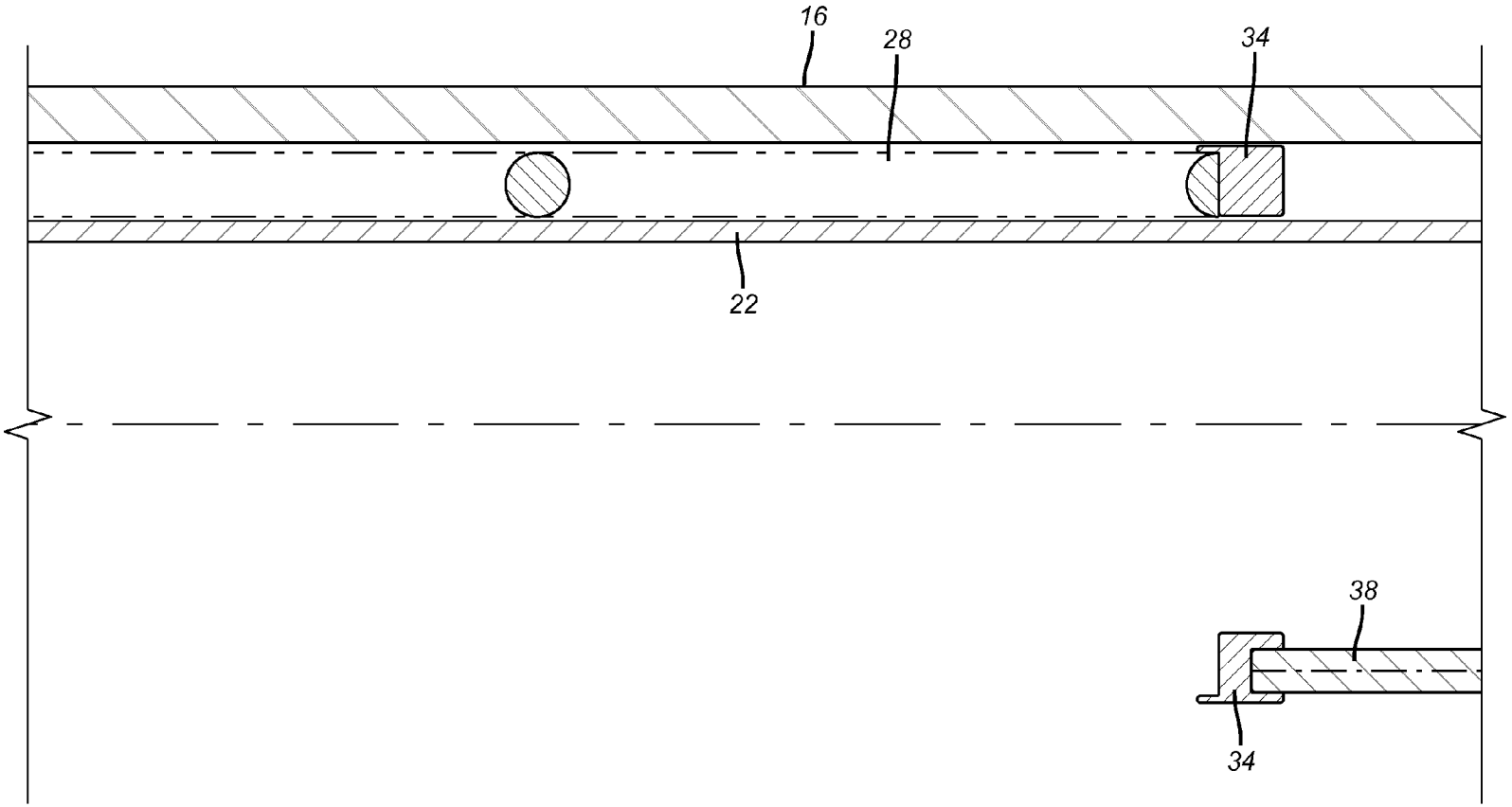
Figure 3:
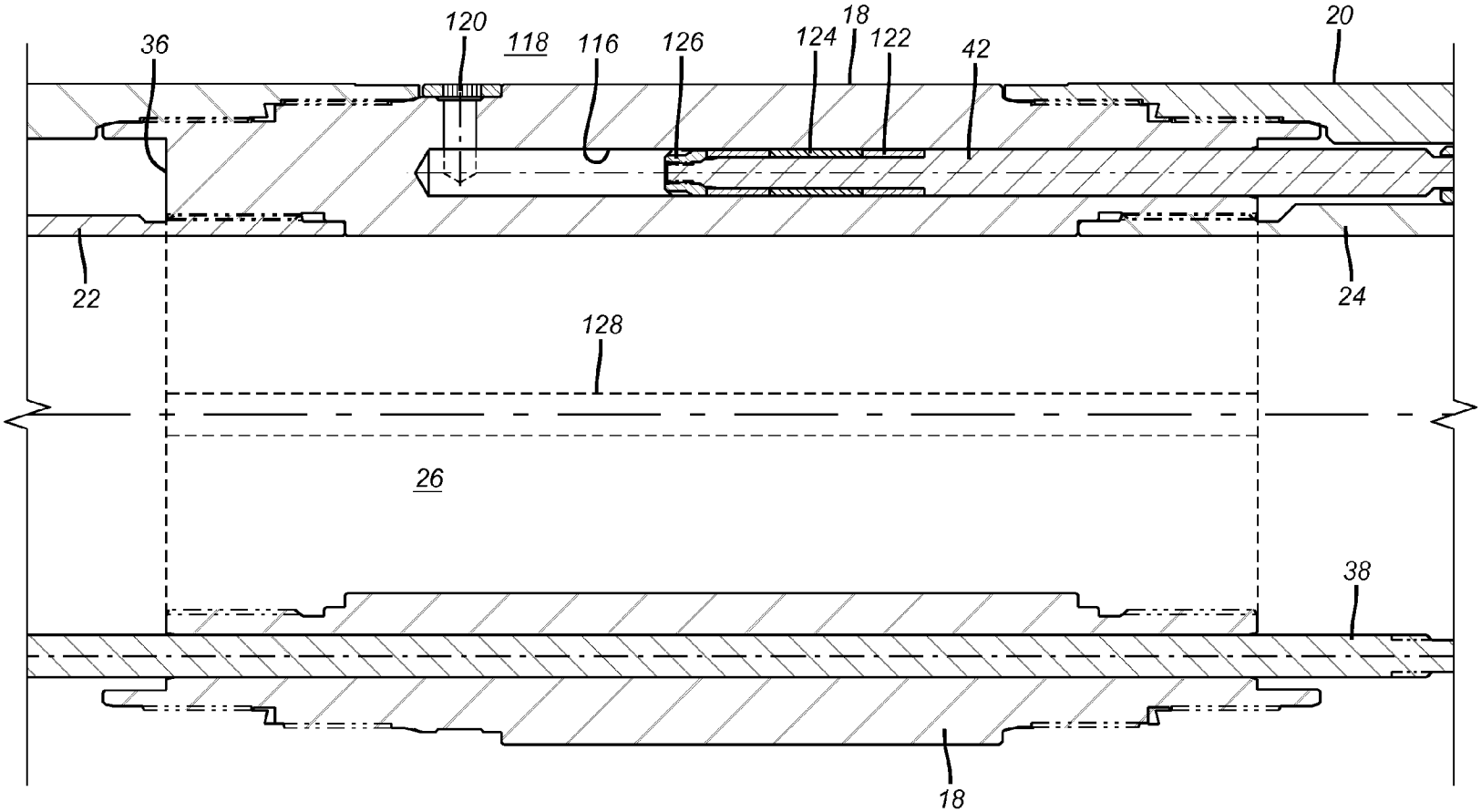
Figure 4:
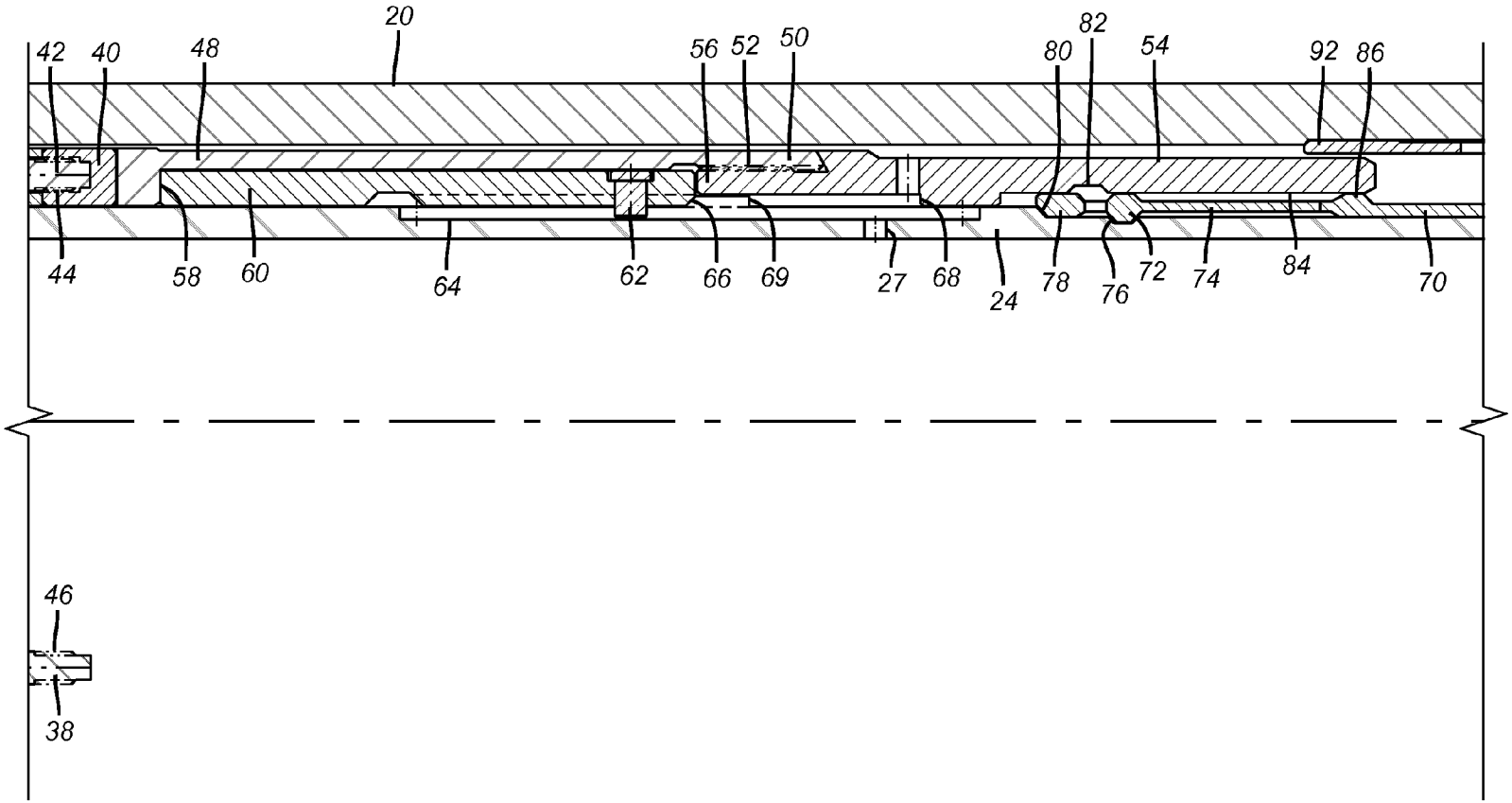
Figure 5:
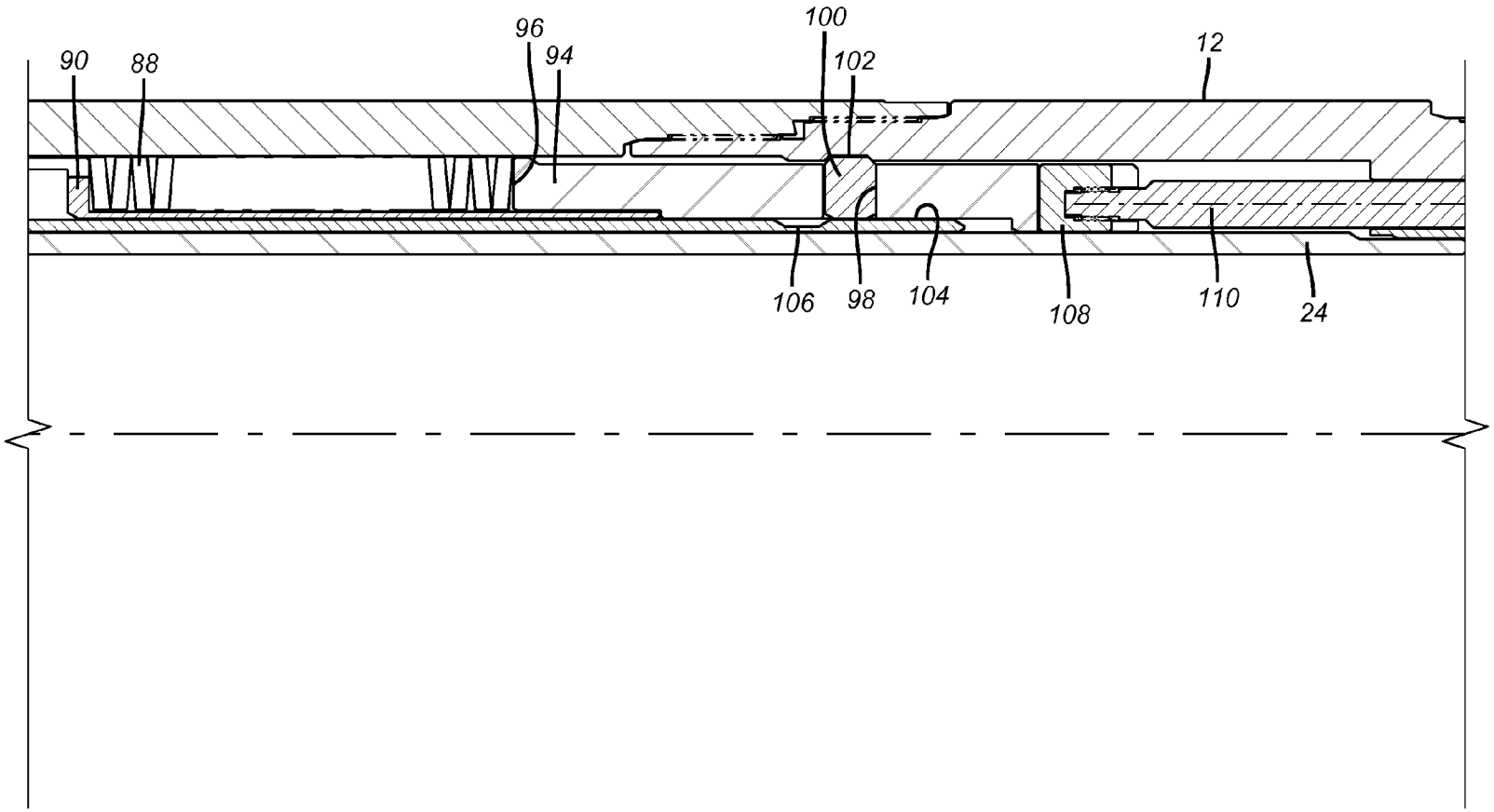
Figure 6:
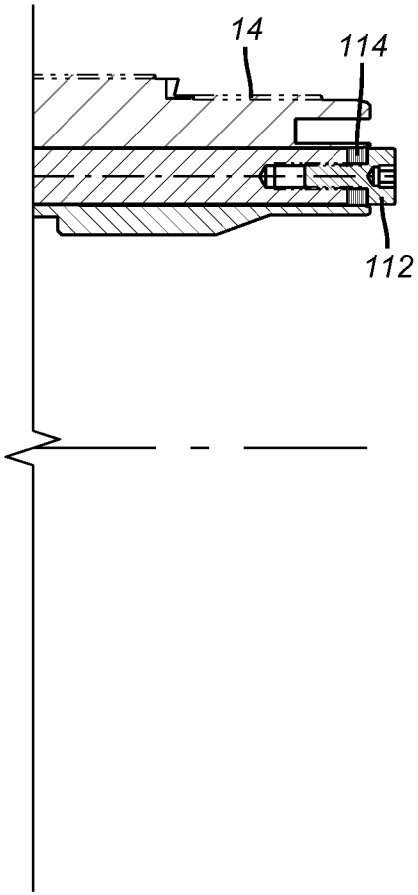

An indexing spring 28 resides in an annular space 30 and bears on shoulder 32 on spring mandrel 22 at a top end and against a spring guide 34 shown in full section in FIG. 2. In the position shown in FIGS. 1-6, the tool T is under bled off pressure in passage 26 in any one of the first 11 cycles and the indexing spring 28 is shown in its most relaxed condition and the spring guide 34 is at a spaced distance from surface 36 of the cylinder sub 18. The spring guide moves with compression rods 38 of which there are preferably two at 180 degrees separation although only one is shown in FIGS. 2-4. Just like the indexing pistons 42 at thread 44 (only one of which is shown although preferably there are two at 180 degree spacing with a 90 degree offset from the compression rods 38) the compression rods 38 are tied to the piston coupler 40 at thread 46. Note the piston coupler 40 is shown in half section so that its connection to the compression rods 38 at thread 46 is not shown.

The piston coupler 40 is connected to the indexing sleeve housing 48 for tandem movement. There are four piston couplers 40 at the pistons 42/compression rods 38. They are contained in windows cut through the wall of the indexing sleeve housing. Holes through the upper face of the indexing sleeve housing 48 allow the threaded ends of the pistons and compression rods to pass through. At a lower end 50 of the indexing sleeve housing 48 is a thread 52 to secure the collet restraint 54. The top end 56 of the collet restraint 54 supports an indexing sleeve 60 against surface 58 of the indexing sleeve housing 48. The indexing sleeve housing 48 moves axially in opposed directions, taking with it the indexing sleeve 60. Since there is a pin 62 mounted to the indexing sleeve 60 that extends into a j-slot pattern 64 on the indexing mandrel 24, the axial movement of the indexing sleeve 62 is accompanied by rotation of indexing sleeve on its own axis. The j-slot pattern that is preferred has opposed up and down positions to accommodate preferably 11 cycles of pressure application and removal in passage 26 so that on the $12^{th}$ pressure application followed by removal in passage 26 a longer movement of pistons 42 will be enabled to actuate the tool T as will be explained below.

The indexing mandrel 24 has a discontinuous shoulder 66 that presents itself upon removal of applied pressure in passage 26 during the first 11 cycles of pressure application and removal in the passage 26. As shown in FIG. 4 the indexing sleeve 60 lands on shoulder 66 11 times before a gap in shoulder 66 presents itself on the $12^{th}$ 12 cycle of pressure removal from passage 26 for operation of the tool T. On the first 11 pressurizing cycles of passage 26, the upward travel limit is defined by shoulder 68 on the collet restraint 54 hitting shoulder 69 on the indexing mandrel 24.

The collet restraint 54 holds the lock collet 70 to the indexing mandrel 24 during the 11 pressure application and removal cycles in passage 26 until the $12^{th}$ pressure removal cycle in passage 26. The lock collet 70 is a tubular member that has a series of collet heads 72 on fingers 74. On assembly, the heads 72 are in a groove 76 in the indexing mandrel 24 and the presence of the collet restraint 54 in contact with the heads 72 locks them into groove 76. The lock collet 70 has a protruding or bulbous end 78 that abuts shoulder 80 of the indexing mandrel 24 and has the collet restraint 54 riding on it. Groove 82 is not as wide as end 78 so that movement of the collet restraint 54 past the end 78 will be smooth as the end 78 will simply straddle the groove 82 as the collet restraint 54 moves down. The fingers 74 are made by machining U-shaped slots through the wall of the lock collet. The bulbous end 78 is a solid ring of material that is integrally connected to the main body of the lock collet 70 by means of the webbed area left between the fingers. The width of groove 82 in the collet restraint is not really critical because the end of the lock collet is essentially a tube that always has clearance with the inside diameter of the collet restraint. In the pressure bled from passage 26 position, during the first 11 cycles, the collet restraint 54 has a surface 84 that will ride on end 78, heads 72 and projection 86. When moved up during the first 11 pressure cycles the surface 84 will move off projection 86 and still ride on end 78 and heads 72 and the lock collet 70 will be held fixed to the indexing mandrel 24.

Preferably a stack of Belleville washers 88 act as a boost force device and push against a spring support 90 that has an upper end 92 that shoulders out against the main housing 20 as shown in FIG. 4. At the opposite end the washers 88 bear on surface 96 of coupler sub 94. Coupler sub 94 has multiple windows 98 through which extend one or more dogs 100 that are initially held in groove 102 in the bottom sub 12 by surface 104 on the lock collet 70. Groove 106 on lock collet 70 is offset at this time from the dogs 100 so that the coupler sub 94 can hold its position against the bias from the washers 88 acting on surface 96.

Connected to the coupler sub 94 is a piston coupler 108 connected to preferably two push rods or actuating pistons 110 spaced at 180 degrees, although only one is shown. The connection here is similar to the one between the pistons and compression rods with the indexing sleeve housing. An adjusting screw 112 can be used with shims 114 to get the proper length to engage the operator of the tool that is not shown and that will be hydraulically operated by the modular tool T. Note that during the 11 cycles of pressure application and removal in the passage 26 the rods 110 do not move. This is mentioned because there can frequently be an accumulation of debris near the lower end of the bottom sub 12 if the barrier valve that is below and not shown in the drawings has been closed for a long time. Reciprocal movement of the rods 110 risks getting them stuck in debris at their lower ends. However, in this design the rods 110 remain locked to the bottom sub 12 until the groove 106 can be presented in alignment with dogs 100 as will be explained below. Also note that cycling of the pistons 42 to compress the indexing spring 28 will not require an applied force to compress the washers 88 that have been pre-compressed on assembly and have that potential energy force on tap when needed on pressure release on the 12$^{th}$ cycle. This is advantageous as the number and piston area of the pistons 42 does not need to be altered for the presence of the secondary source of force from the washers 88. Washers 88 are selected preferably as they deliver a greater force for a short distance than other types of biasing devices. The extra force from the washers 88 is needed to initially move a closed ball, for example, in a barrier valve that is not shown that has to be rotated when subjected to large differential pressures. The applied force of the push rods 110 could be as high as thousands of pounds depending on the differential pressure on the closed ball when trying to open it.

Referring back to FIG. 3, the pistons 42 reciprocate in respective cylinders 116 that are open to the surrounding annulus 118 through a screened opening 120. Each piston 42 rides on a bushing 122 and has a seal 124 retained to it by a retainer 126. A wall passage 128 is illustrated schematically that connects annular space 30 to annular space between indexing mandrel 24 and main housing 20. Applied pressure in passage 26 acts through port 27 on the lower side of seal 124 and against the pressure in the annulus 118 that communicates to the higher side of seal 124 through the screened opening 120. Thus, a pressure differential is created across seal 124 with applied pressure.

Fluid displacement from annular space 30 as the spring guide 34 moves is handled through an opening 130 shown in FIG. 1 that is preferably a plurality of narrow spaces slots made by wire EDM techniques so that fluid can move while debris is blocked.

Figure 7:
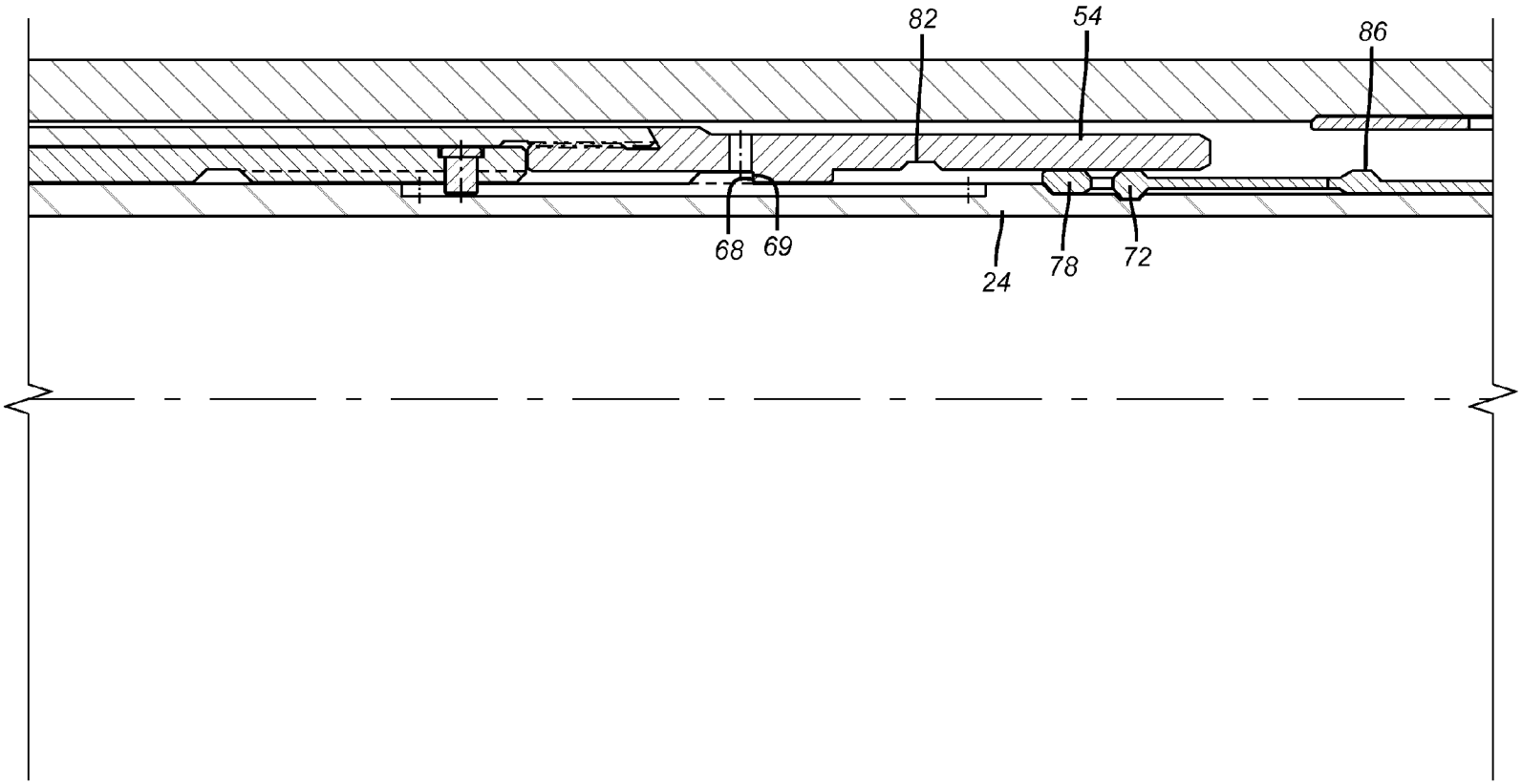
FIGS. 7-9 correspond to FIGS. 4-6 with the tool in its position with tubing pressure applied and against an upper travel stop.
Figure 8:
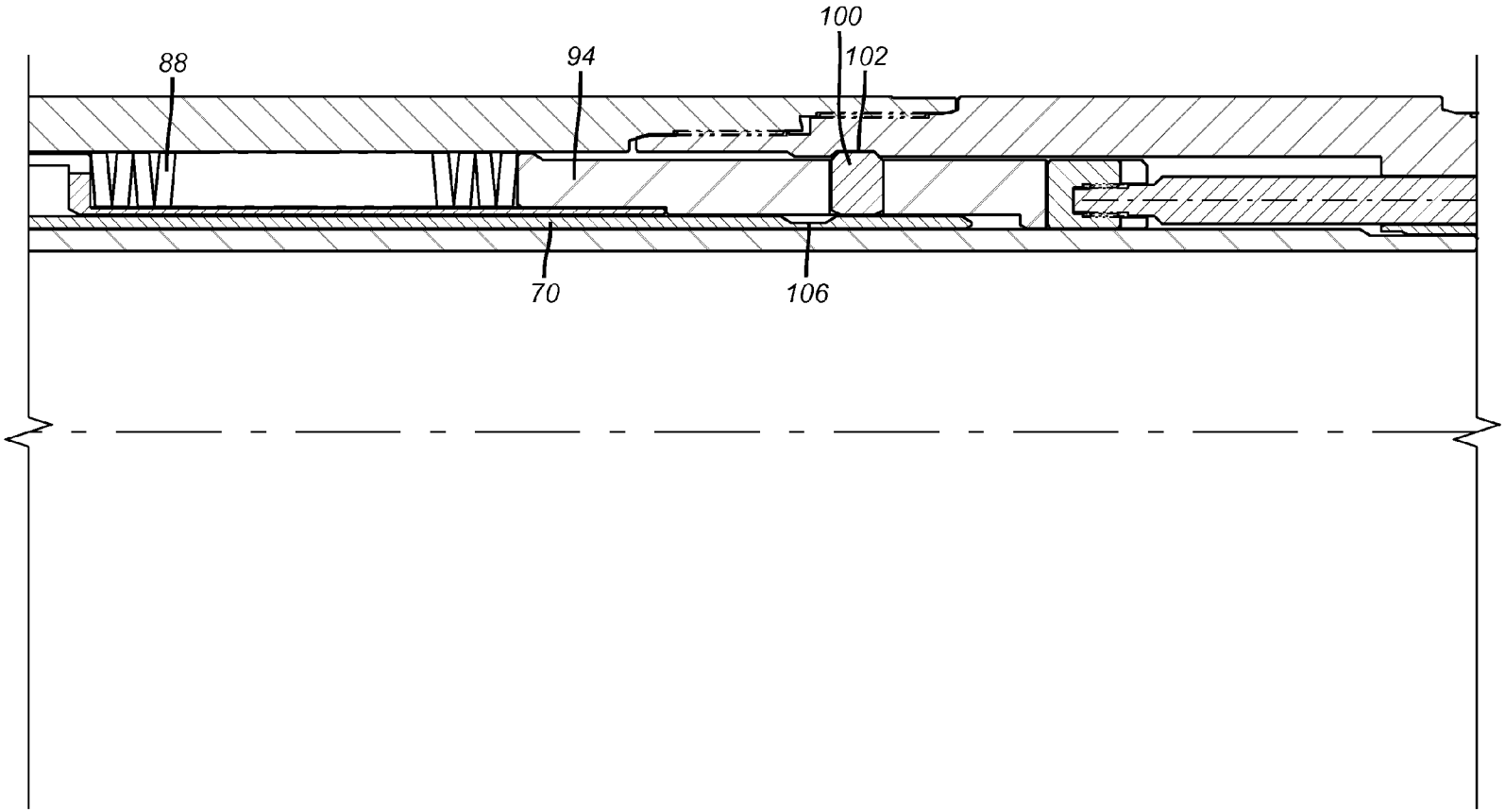
Figure 9:
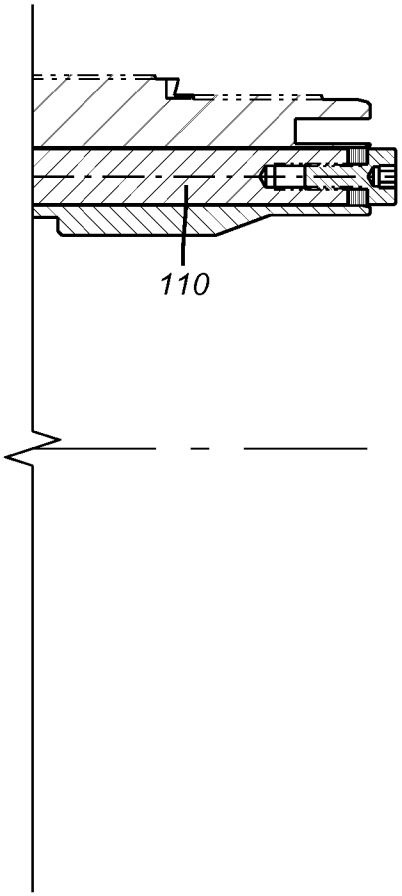

FIGS. 7-9 show the movement of the collet restraint 54 on pressure application to passage 26 until surfaces 68 and 69 engage. What has happened is that the upward movement of the pistons 42 has not only compressed the indexing spring 28 because the compression rods 38 have moved in tandem with the pistons 42 but also the indexing sleeve 48 has come up and taken with it the collet restraint 54. Now the collet restraint 54 is no longer over projection 86 but it is still over the collet heads 72 and the bulbous end 78 of the lock collet 70. The force of the washers 88 is still locked as dogs 100 are still held in groove 102 by the lock collet 70 and groove 106 is still offset from the dogs 100. Push rods 110 have not moved. Thus FIGS. 1-6 show the positions of the part on removal of pressure in passage 26 for the first 11 times and FIGS. 7-9 show the position on application of pressure for each of those 11 cycles as well as the pressurization during the 12$^{th}$ cycle. What happens on the 12$^{th}$ cycle pressurization is that the gap in the shoulder 66 presents itself in alignment with the indexing sleeve 60 so that on the pressure removal for the 12$^{th}$ time, the indexing sleeve 60 and the attached collet restraint can move an extra distance that allows groove 82 to align with heads 72 to effectively unlock the lock collet 70 from the indexing mandrel 24 and connect the lock collet 70 to the advancing collet restraint 54 until groove 106 comes into alignment with dogs 100 and the force of the washers 88 can now be applied to move the coupler sub 94 and the attached push rods 110 so that the initial force to open the barrier valve that is not shown occurs with the tandem force of the indexing spring 28 as well as the washers 88 until an internal travel stop is encountered as will be explained using FIGS. 10-12 below.

Figure 10:
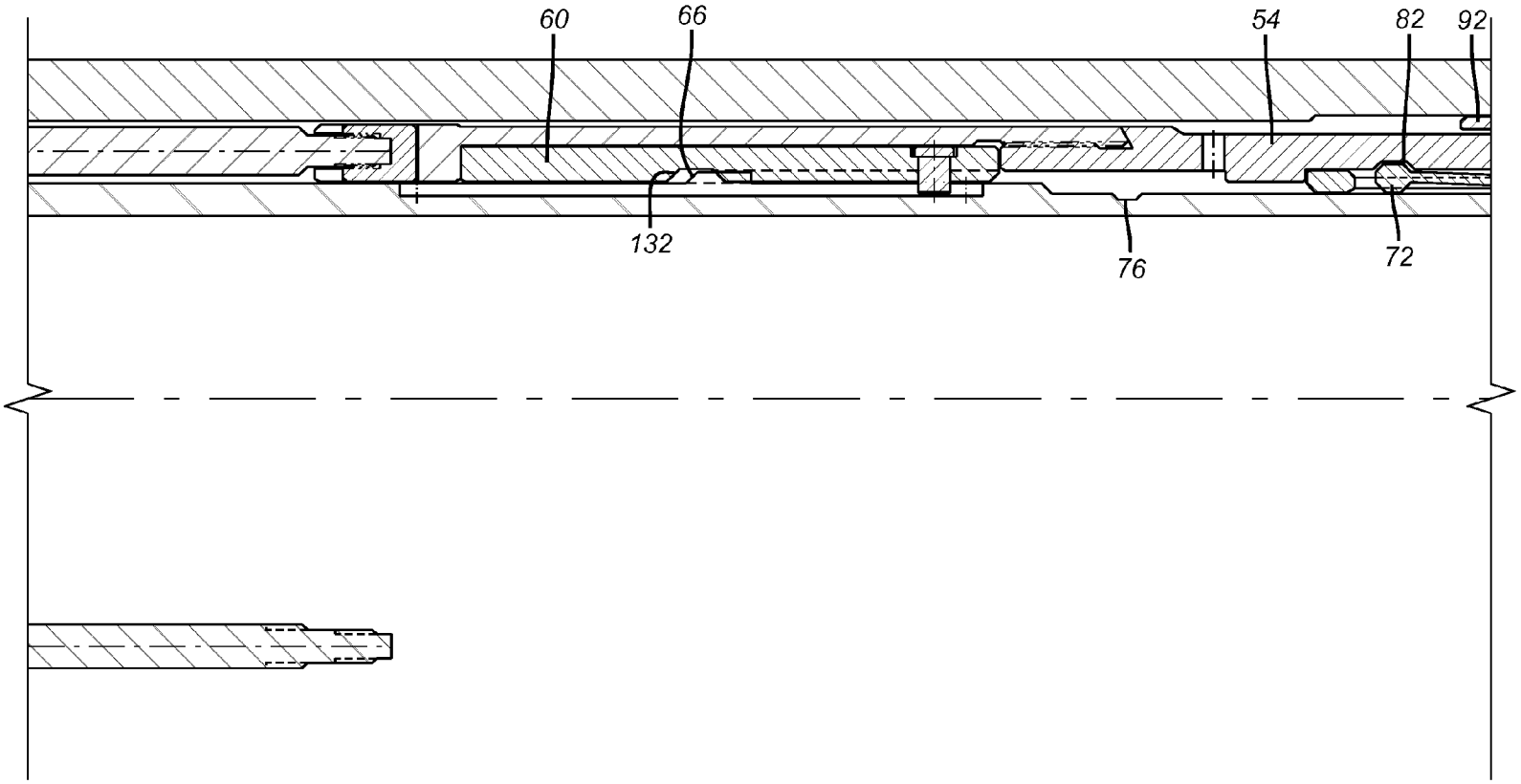
FIGS. 10-12 correspond to FIGS. 4-6 shown after removal of tubing pressure after a predetermined number of cycles so that the associated tool is operated.
Figure 11:
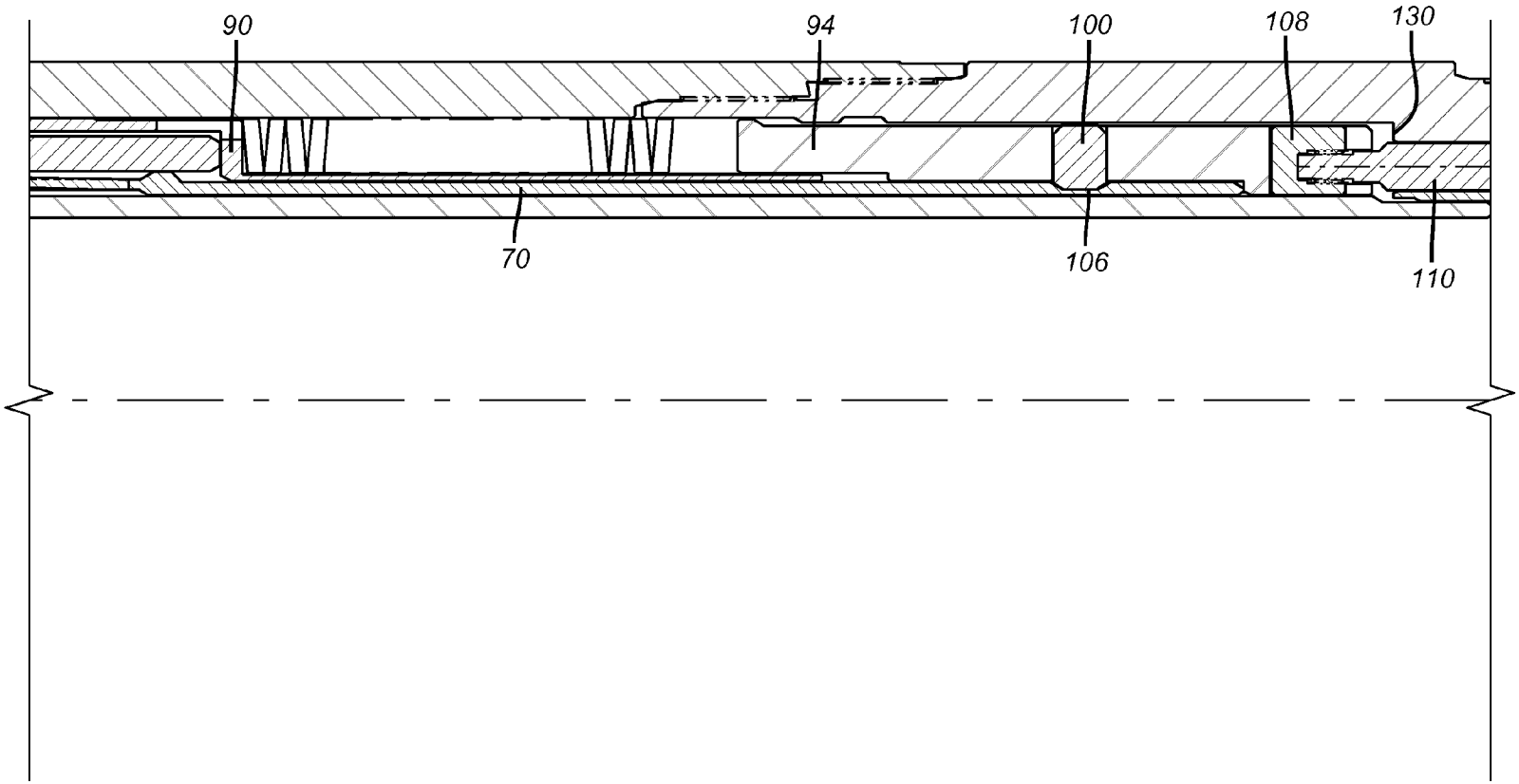
Figure 12:
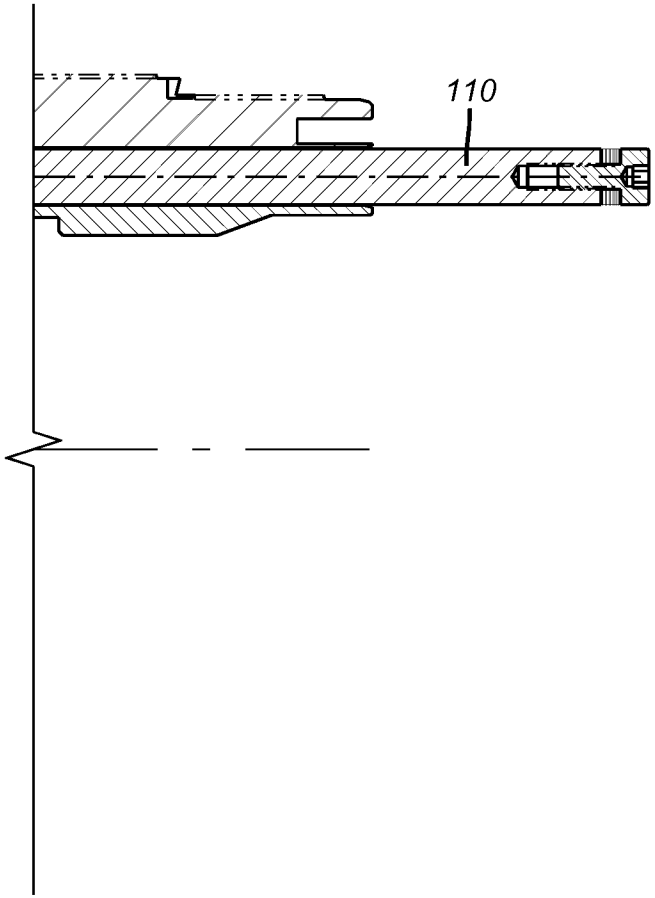
Figure 13:
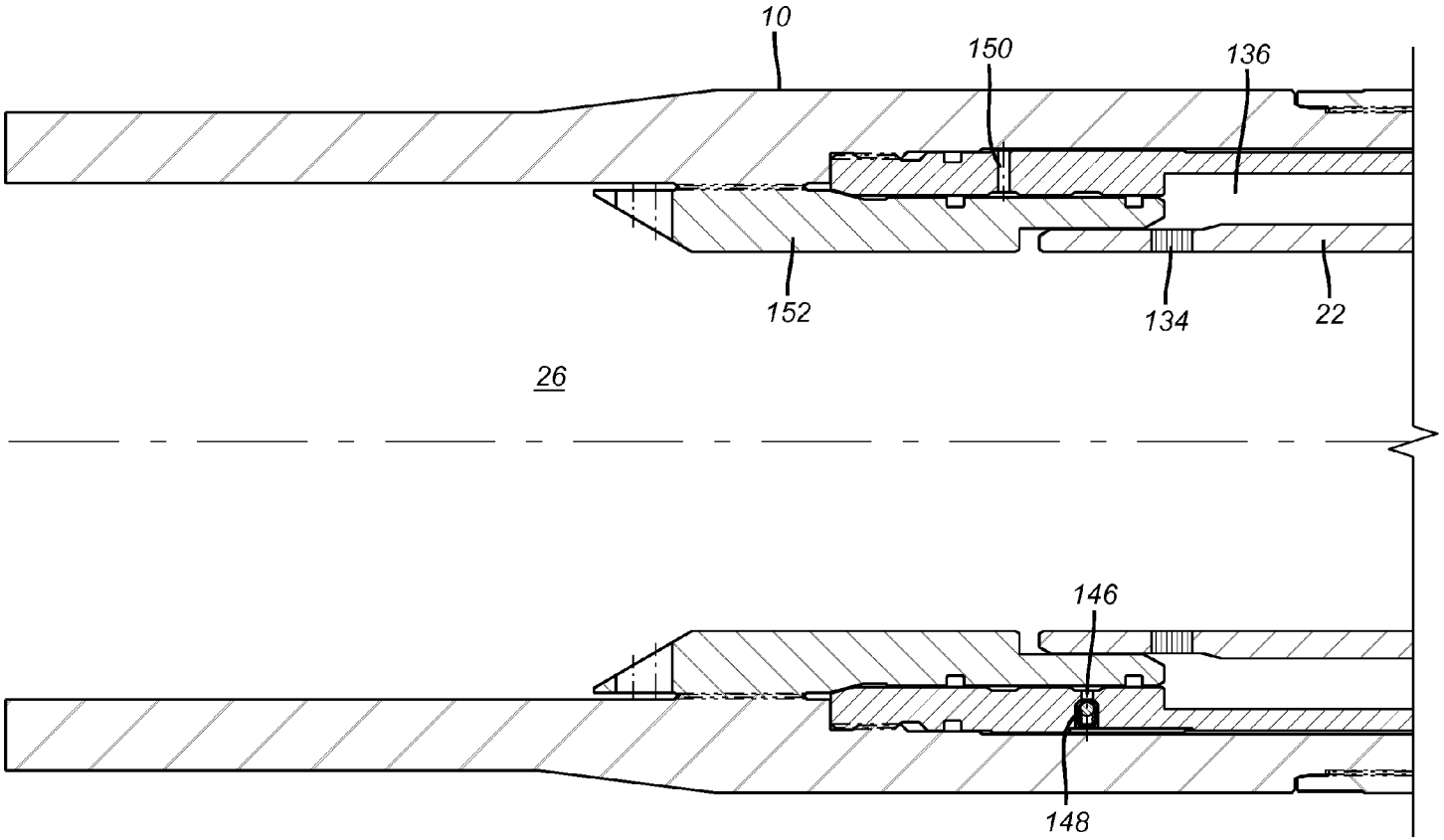
FIGS. 13-17 correspond to FIGS. 1-3 showing an alternative embodiment for access of applied tubing pressure against a fluid filled reservoir isolated from well fluids with a floating piston.
Figure 14:
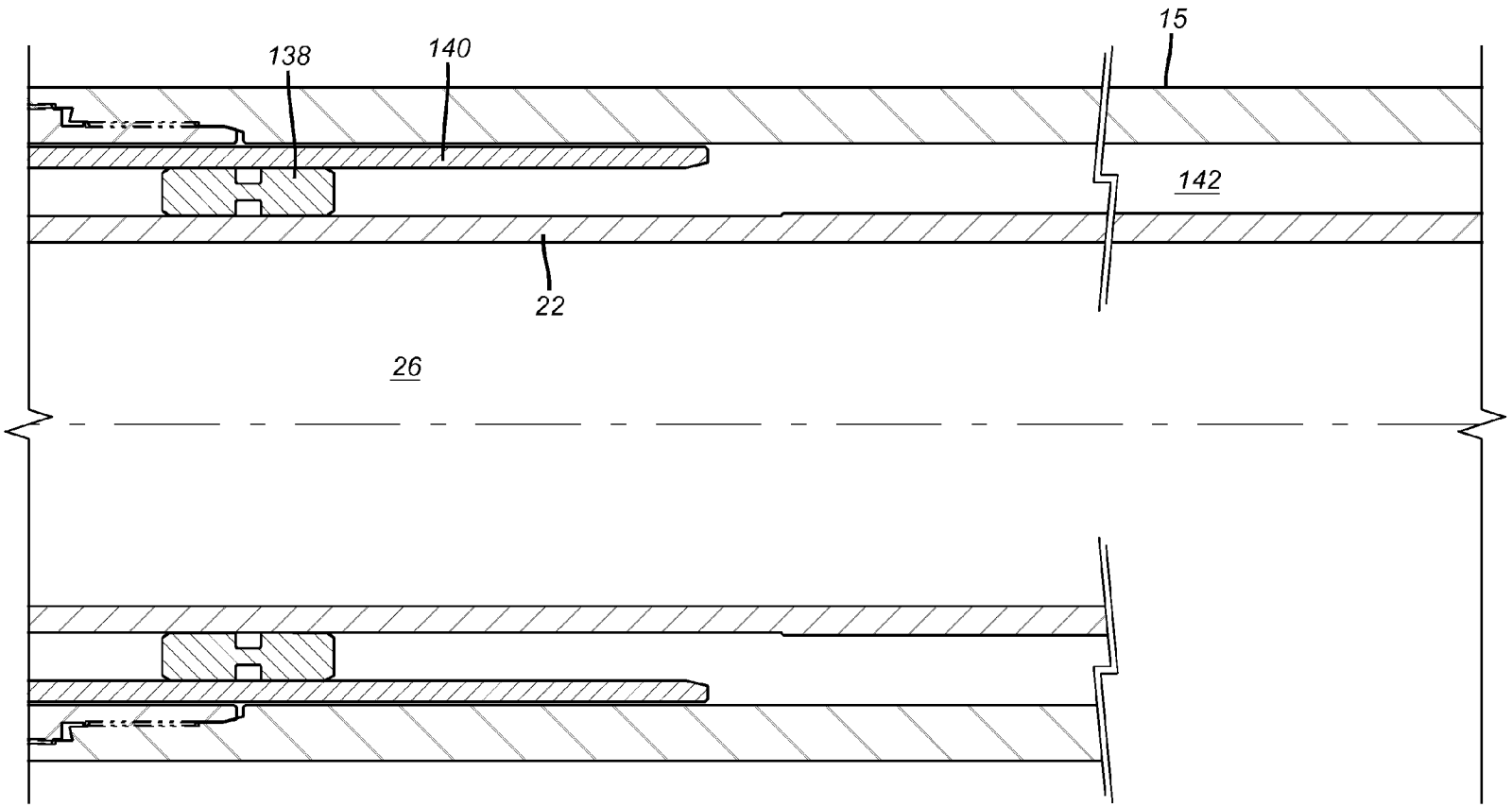
Figure 15:
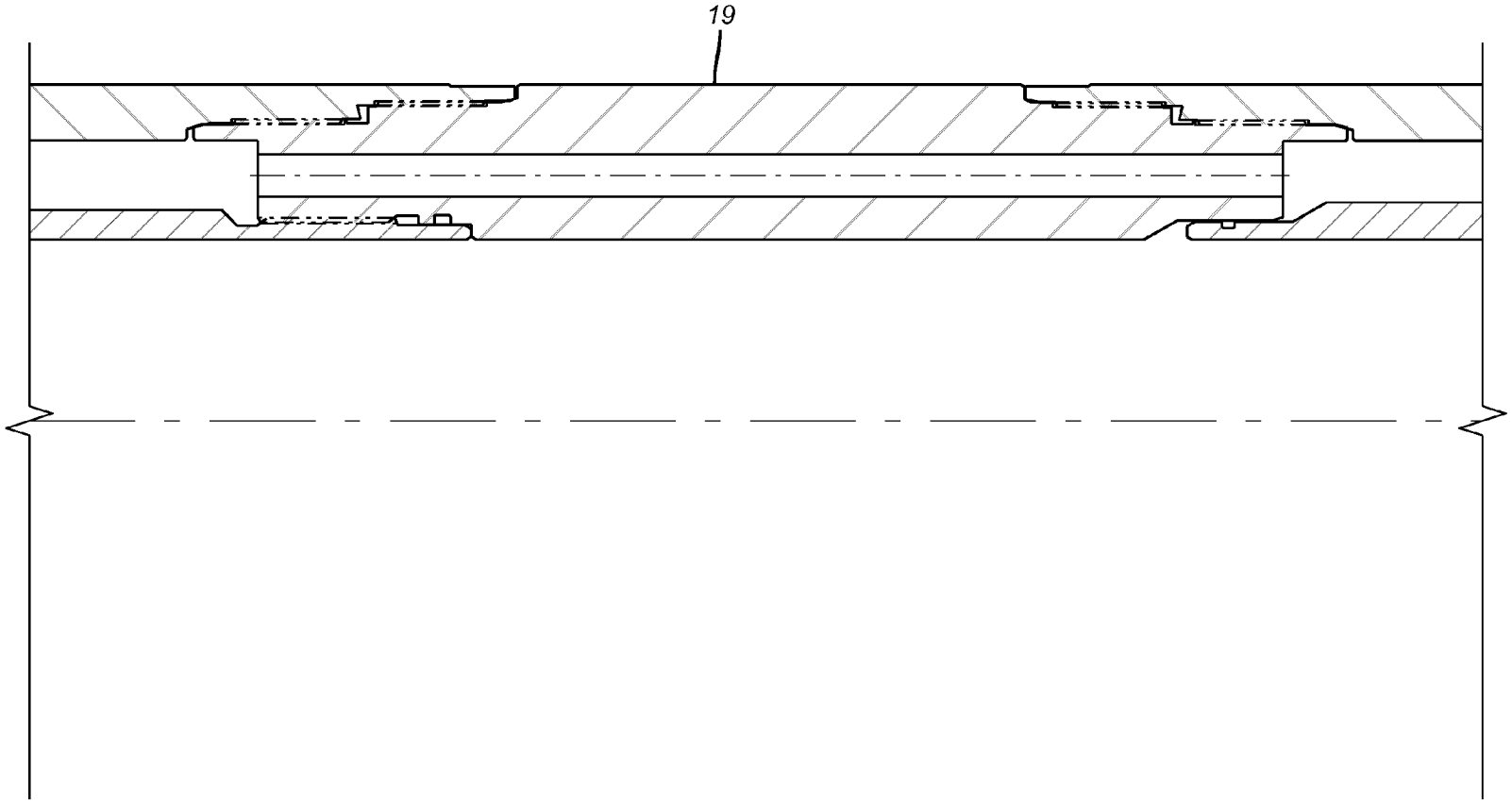
Figure 16:
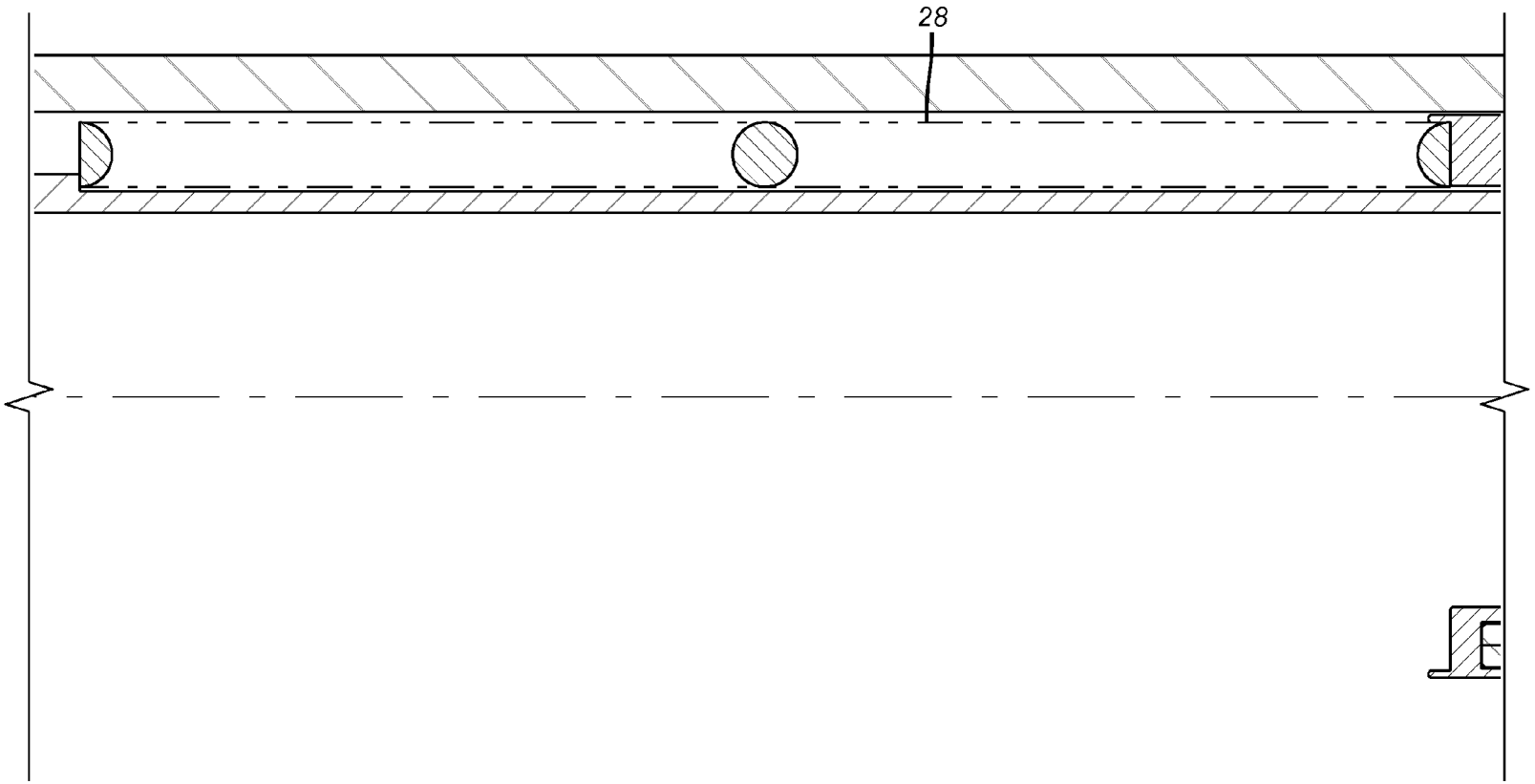

As shown in FIGS. 10-12 a gap in ridge 66 has presented itself so that the indexing sleeve 60 can move further than the previous 11 removals of pressure from the passage 26. As a result the groove 82 on the collet restraint 54 has registered with the heads 72 to trap the lock collet 70 to the collet restraint 54 for tandem movement. That tandem movement has put the groove 106 into alignment with dogs 100 to allow the coupler sub 94 and the push rods 110 to extend from the bottom sub 12 under the initial tandem force of the indexing spring 28 and the washers 88. Note that spring support 90 has its upper end 92 moved away from a shoulder on the main housing 20, see FIG. 4, by the movement of the collet restraint 54. At that point the washers 88 are no longer backstopped by the main housing 20 and can no longer provide a force to move the coupler sub 94 and the connected push rods 110. With a barrier valve or some other tool having an operator in abutment with the push rods 110, the movement of the parts will cease when the actuation assembly of the tool against which the push rods 110 abut no longer permits further movement. This embodiment of the tool T is not resettable. Once the push rods 110 are extended and the barrier valve below is opened with hydraulic pressure the tool T has served its purpose and its usefulness is done.

Note that the boost force for initial opening from the washers 88 can be adjusted to last a longer or shorter duration of the push rod 110 movement by reconfiguration of the stack of washers 88 and/or the parts that are unleashed to move with the pressure removal on the 12$^{th}$ cycle. Optionally, the boost force from the washers 88 can last for the duration of the movement of the push rods 110.

Note that if there is no tool operating mechanism available to stop the push rods 110 such as when the tool T is bench tested then one travel stop for the push rods 110 can be when the piston coupler 108 hits surface 130 in FIG. 11. Alternatively some part of the indexing sleeve 60 can be configured to engage the continuous portion of the shoulder 66 at a rotated location from the discontinuous portion of that shoulder 66 using a surface such as 132 on the indexing sleeve 60.

Figure 17:
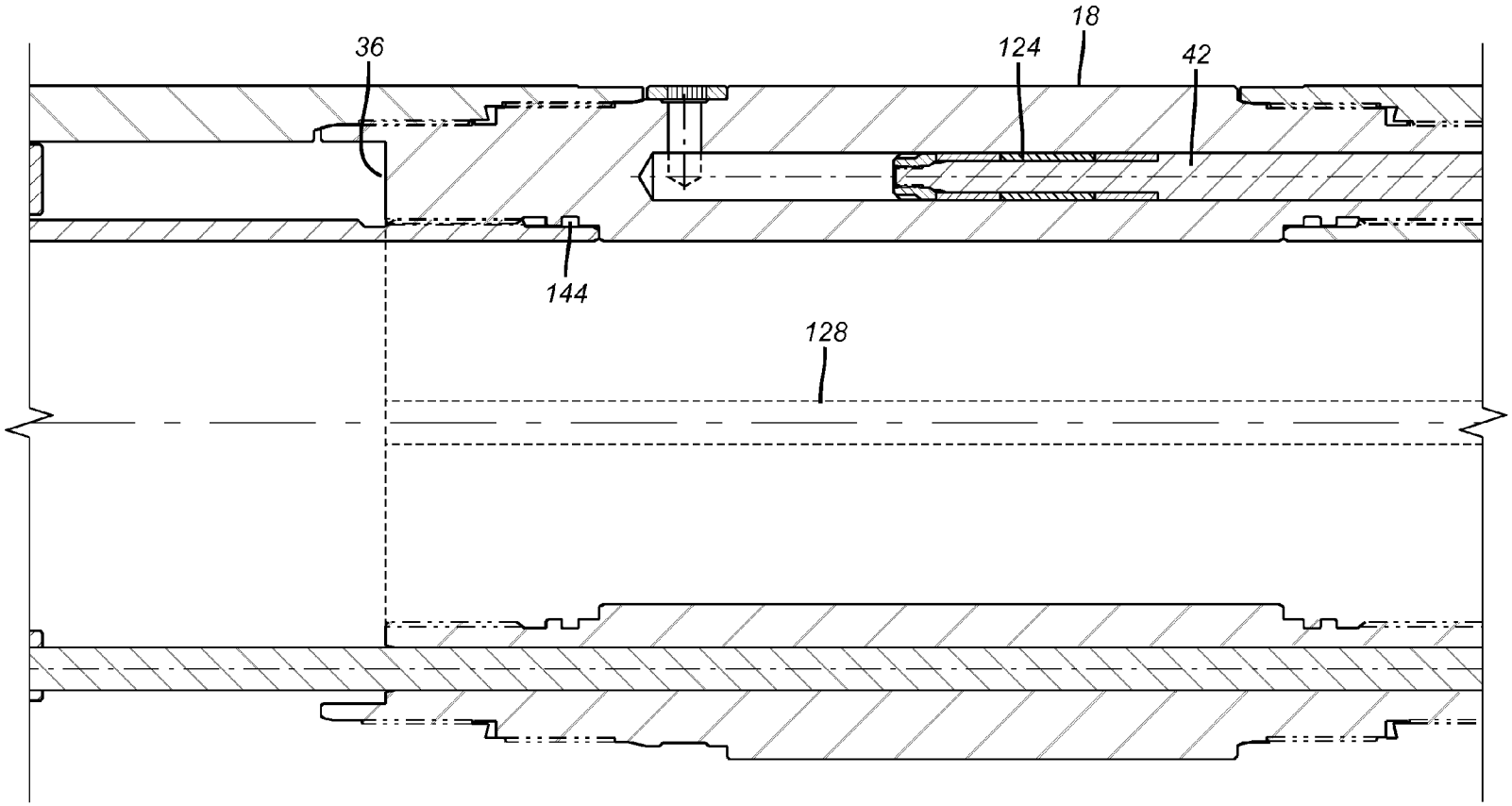

It should be noted that the indexing assembly for this embodiment comprises the moving parts between the indexing spring 28 and the piston coupler 108 and outside the passage 26 whose movement causes the actuating piston 110 to actuate the barrier tool. For the subsequent embodiment the indexing assembly comprises the moving parts outside the passage 200 and between and including the indexing spring 210 and the actuating piston coupler 226 whose movement causes actuating pistons 222 to actuate the barrier tool Referring to FIGS. 13-16 it may be desirable to move the pressure entry point to reach the seal 124 through passage 128 as described before to a higher location on the tool T simply to keep the inlet location for pressure application away from the zone where debris can accumulate if the barrier valve below has been closed for a long time. Rather than having the passage 26 access the passage 128 fairly close to the bottom end of the tool T as in FIGS. 1-6, the FIGS. 13-17 disclose an alternate location for applied pressure in passage 26 to reach the passage 128 in the wall of the cylinder sub 18. The inlet 134 can be in the spring mandrel 22 or it can even be moved higher by extension of the length of the mandrel 22 and the top sub 10. As with inlet 130 in FIG. 1 inlet 134 is made with narrow slots using wire EDM to keep debris out of chamber 136 defined by floating piston 138, spring mandrel 22 and extension mandrel 140. Chamber 142 is filled with clean incompressible oil or a slightly compressible material such as silicone and extends through extension housing 15 to connector sub 19 and around the indexing spring 28 until terminating at surface 36 in FIG. 17. A seal 144 seals the lower end of the passage 142. By way of the ports in the connector sub and the wall passage in the cylinder sub, the hydraulic fluid extends all the way down to the push rods covering all of the internal mechanism. There is a seal between the bottom sub and indexing mandrel as well as on the push rods to contain the clean oil. Pressure applied at inlet 134 pushes on the floating piston 138 to pressurize passage 142 and 128 to move the pistons 42 in the manner described before. The floating piston 138 is used to allow for compensation for thermal loads from well temperature changes. Extension mandrel 140 has a fill port 146 with a check valve 148 to allow filling the passage 142 with clean oil while venting air through vent 150. After the filling and air venting is concluded an isolation plug 152 is put into position to close off the fill port 146 and the vent 150.

Figure 18A:
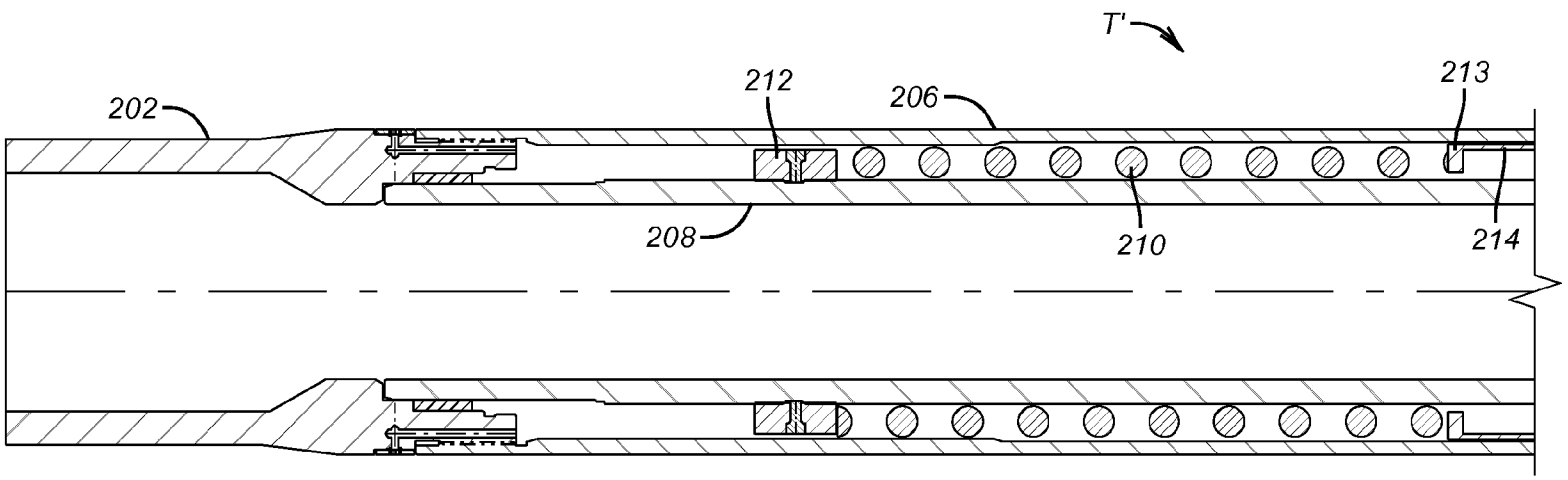
FIGS. 18*a-c* show an alternative embodiment in section in the pressure relieved position before the final controlled element is actuated.
Figure 18B:
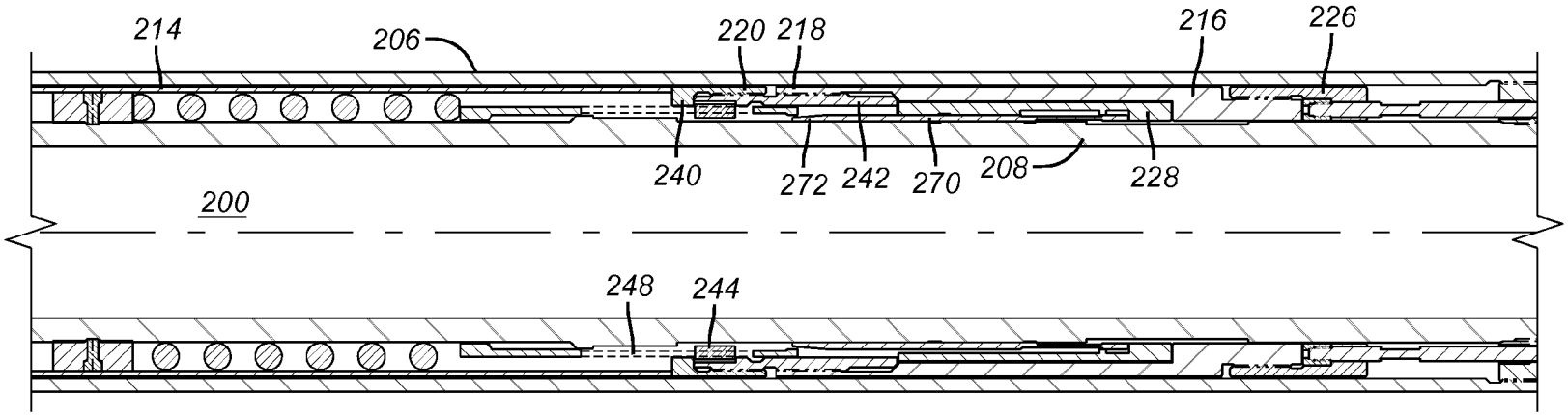
Figure 18C:
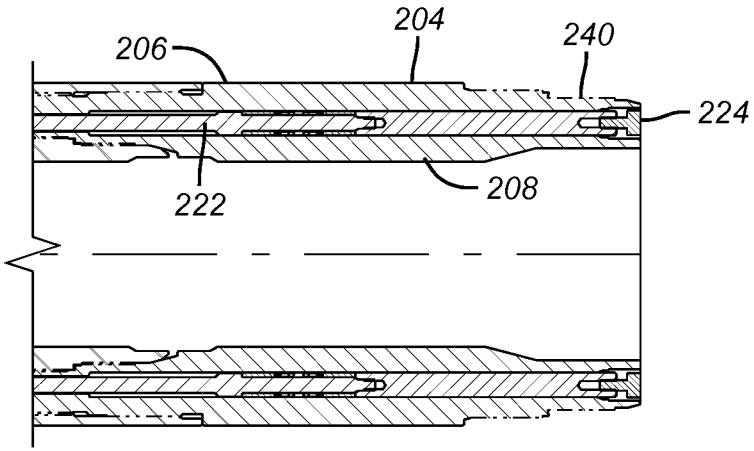
Figure 22:
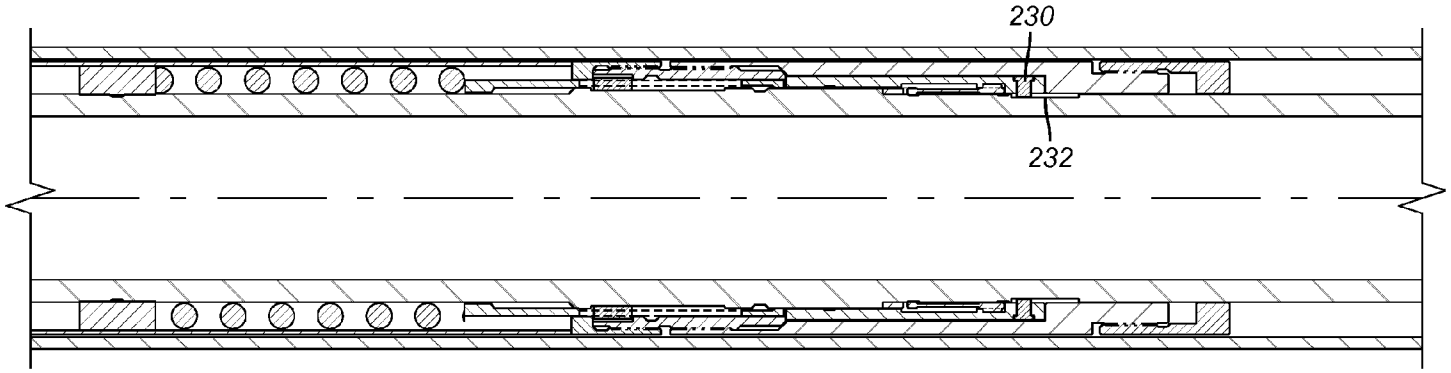
FIGS. 22 and 23 are rotated sections of FIG. 21*a* shown in the same position.
Figure 27:
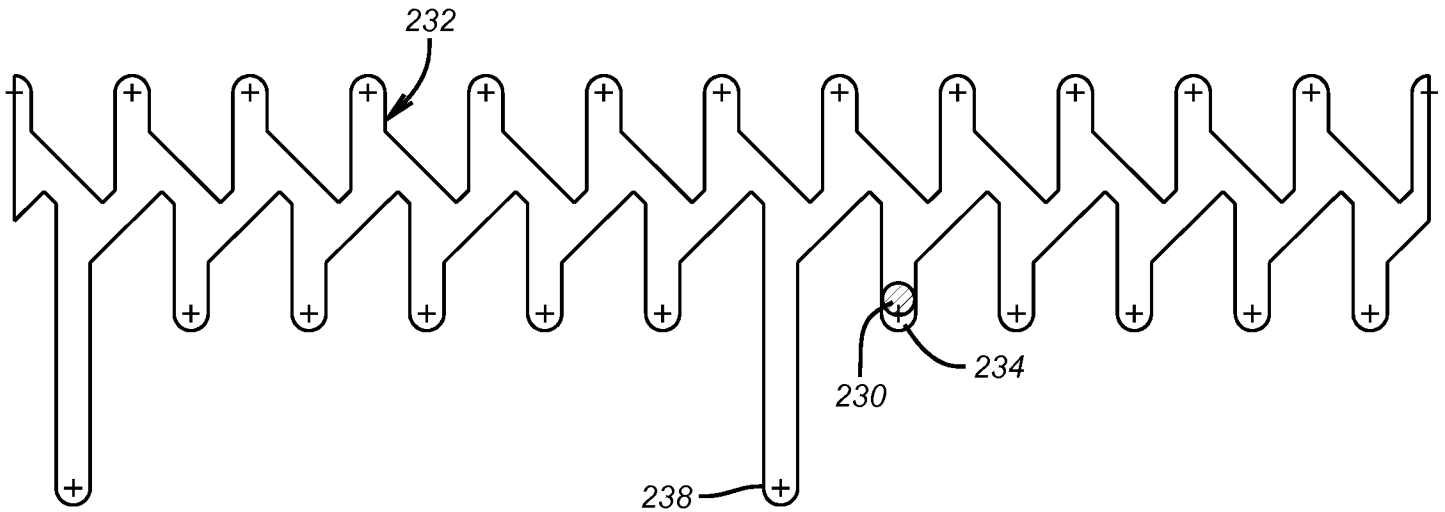
FIG. 27 is a rolled flat view of the j-slot that can be used with either embodiment.

An alternative embodiment that is resettable is shown in FIGS. 18*a-c* in the 11 positions of relief of pressure in the passage 200. The tool T' has a top sub 202 and a bottom sub 204 connected by a spring housing 206. Indexing mandrel 208 also is connected between the subs 202 and 204 and defines the passage 200 through the tool T'. An indexing spring 210 bears on stop 212 secured to the indexing mandrel 208. The other end of the indexing spring 210 pushes on the shoulder at the top end 213 of the spring guide extension 214. A housing 216 has an upper end 218 that is connected to the lower end 220 of spring guide 240 by the spring guide coupler 242 so that when pressure in passage 200 acts on the lower end 224 of actuating piston 222 there is tandem movement from the piston 222 to the top end 213 of the spring guide extension 214 to compress the indexing spring 210. Piston coupler 226 connects the piston 222 to the housing 216. Housing 216 translates with indexing sleeve 228 as sleeve 228 turns on its center axis because it has a pin 230 (see FIGS. 22 and 27) that extends into a j-slot pattern 232. The position 234 of the pin 230 in the j-slot 232 represents its location when pressure is bled off the passage 200 for the $11^{th}$ time. In the next or $12^{th}$ pressure application, the pin 230 will go to position 236 and then when the pressure in passage 200 is bled off, the pin will move to position 238 an extra distance longer that the other 11 cycles so that the piston 222 can extend out of the bottom sub 204 to actuate the connected tool (not shown) at thread 240 as will be explained below.

Figure 19:
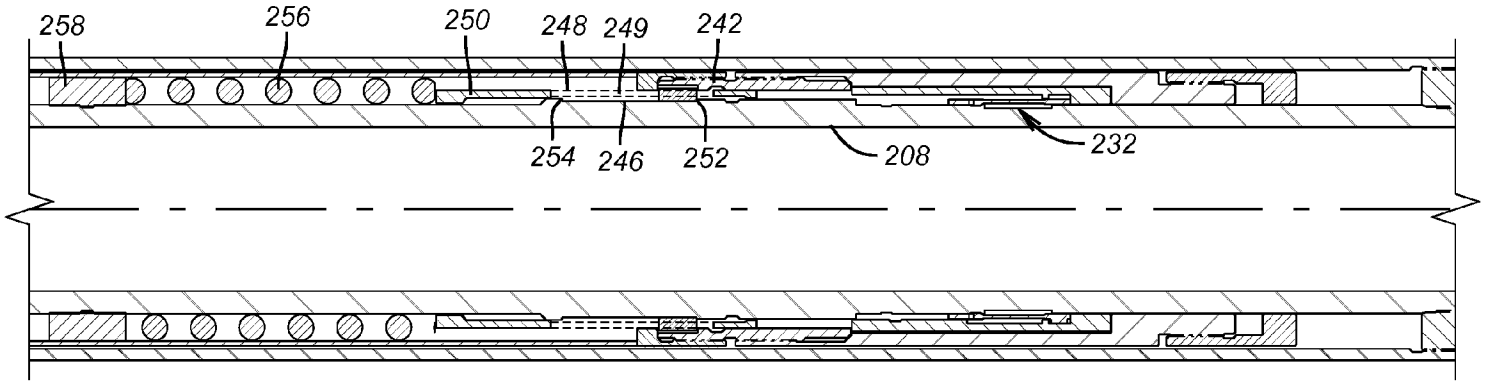
FIGS. 19 and 20 are rotated sections of FIG. 18*b* with the tool in the same position.

The spring guide extension 214 is connected to the spring guide 240. Lock keys 244 are retained by the spring guide coupler 242 against surface 246 of the indexing mandrel 208 as best seen in FIG. 19. The lock keys 244 ride in slots 248 represented by dashed lines 249 in lock key housing 250. Lock keys 244 can slide between opposed travel stops 252 and 254 as pressure is removed and applied in passage 200 and as pin 230 follows in j-slot 232 between the 232 and the 234 positions during the 11 pressure application and removal cycles.

Figure 20:
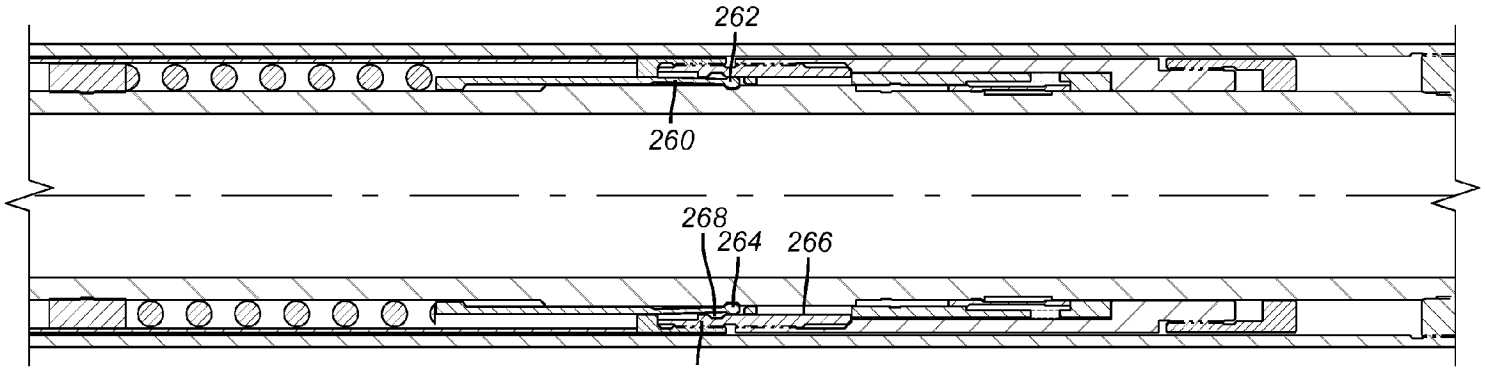
Figure 21A:
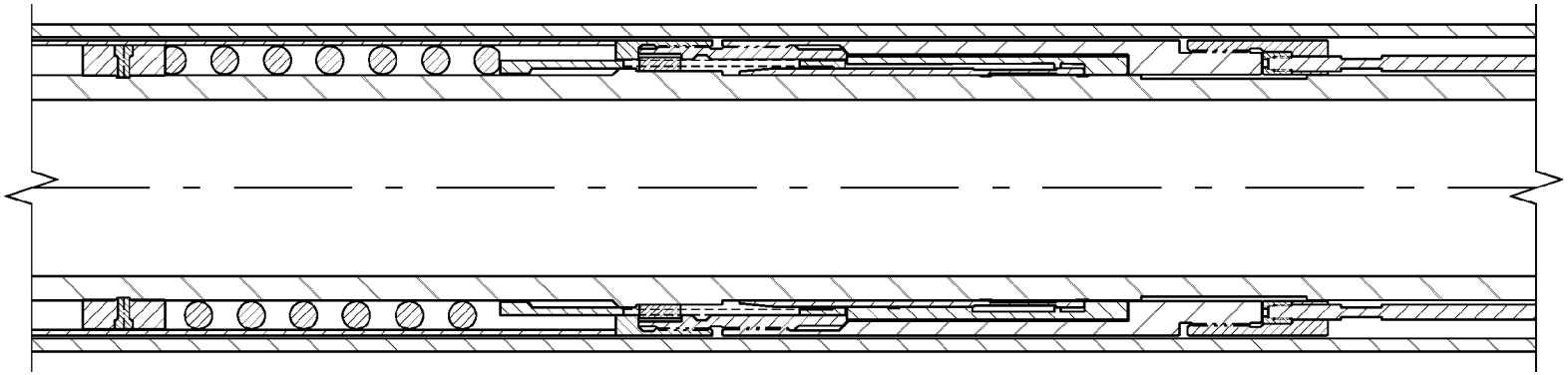
FIGS. 21*a*-21*b* are the view of FIGS. 18*b*-18*c* shown in the pressure applied condition.
Figure 21B:
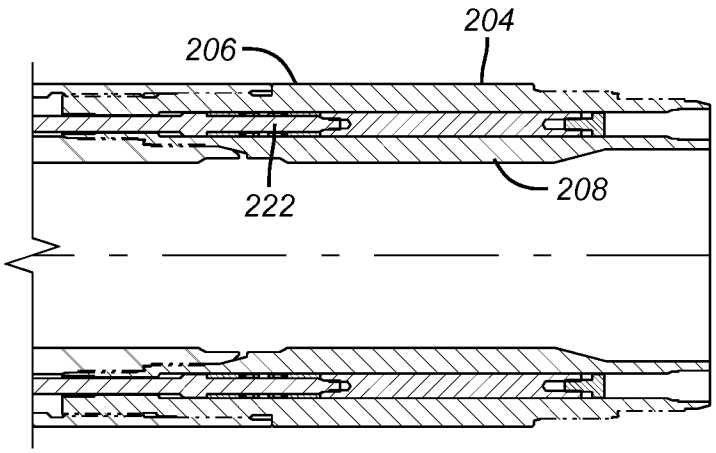
Figure 23:
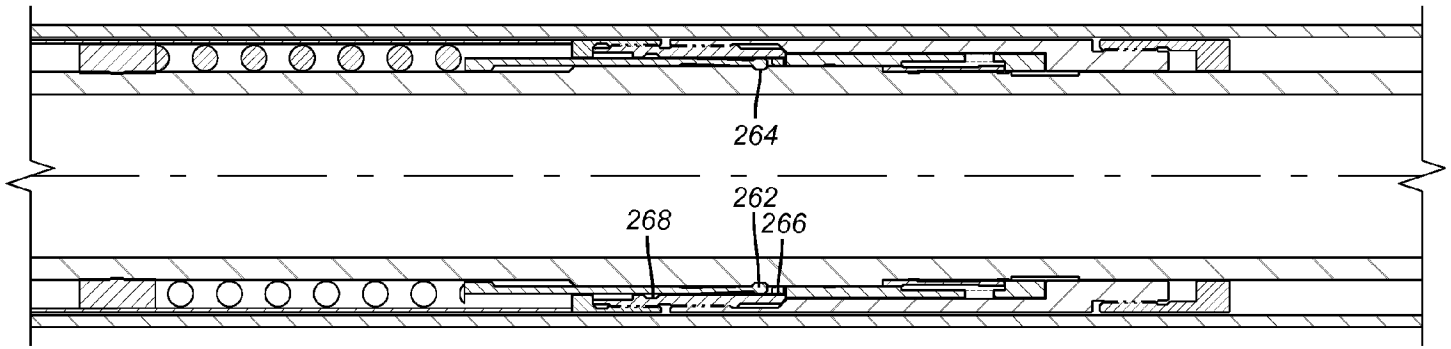

One end of a booster force device such as a spring 256 is supported by a stop 258 that is attached to the indexing mandrel 208. On the other end of booster spring 256 is lock key housing 250 which during the 11 cycles of pressure application and removal cannot move so that the boost force stored in spring 256 is retained during the 11 cycles. FIG. 20 illustrates that the lock key housing 250 has collet fingers 260 with heads 262 located in groove 264 and held trapped there by surface 266 of spring guide coupler 242. FIG. 20 shows the relative part positions with the pressure in passage 200 released and FIG. 23 shows the pressure applied position in all cycles. Comparing FIGS. 20 and 23, it can be seen that surface 266 has slid along the collet heads 262 so that in FIG. 23 the groove 268 has moved away from heads 262 that are still trapped by surface 266 in groove 264. Thus in both the FIGS. 20 and 23 positions representing respectively removal of pressure in the first 11 cycles and application of pressure in all cycles the stored force of booster spring 256 is retained between the stop 258 and the immobile lock key housing 250.

A ramp sleeve 270 moves axially with the indexing sleeve 228 and is configured to release from the movement of the indexing sleeve 228 when the pressure is released for the $12^{th}$ cycle in passage 200. The ramp sleeve 270 by not moving with the indexing sleeve 228 allows use of its ramped end 272 to push the lock keys 244 radially outwardly enough so the keys 244 will clear the stop 252 that they have hit on the previous 11 occurrences of relief of pressure in the passage 200. At the same time at the $12^{th}$ relief of pressure in passage 200 the pin is in position 236 in the j-slot 232 and is now able to have extended movement to location 238 in the j-slot 232, see FIG. 27.

Figure 24A:
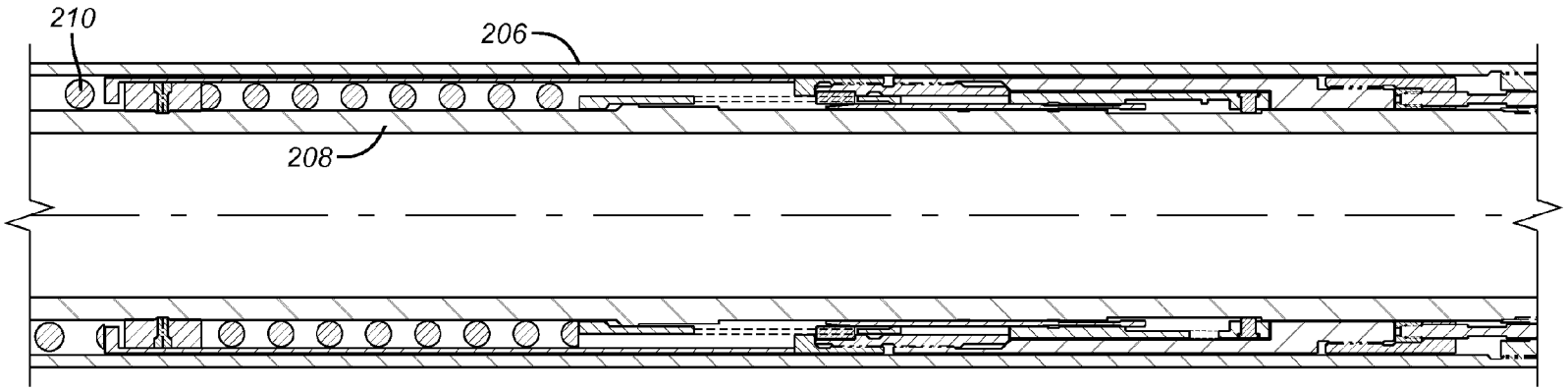
FIGS. 24*a*-24*b* are the view of FIGS. 18*b*-18*c* in the actuated position with the boost force applied.
Figure 24B:
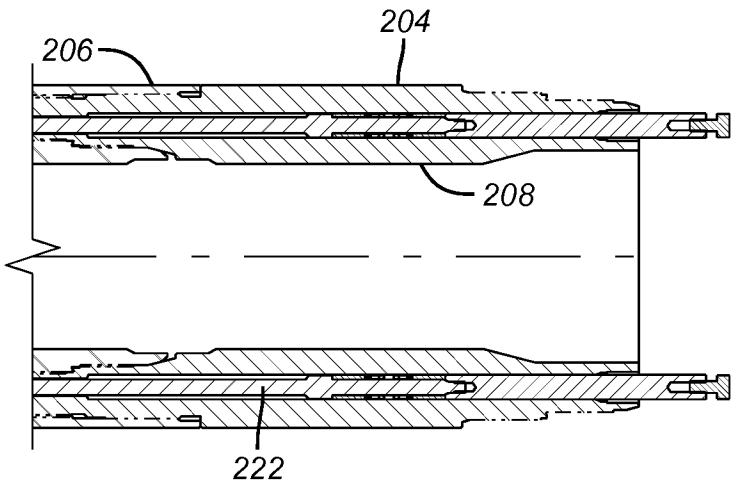
Figure 25:
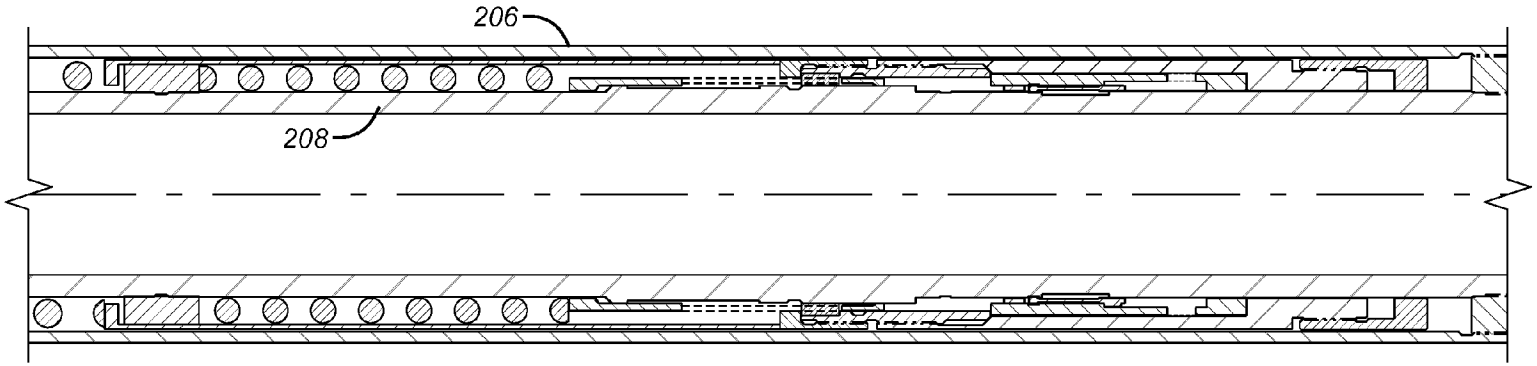
FIGS. 25 and 26 are rotated views of FIG. 24*a* in the same position.
Figure 26:
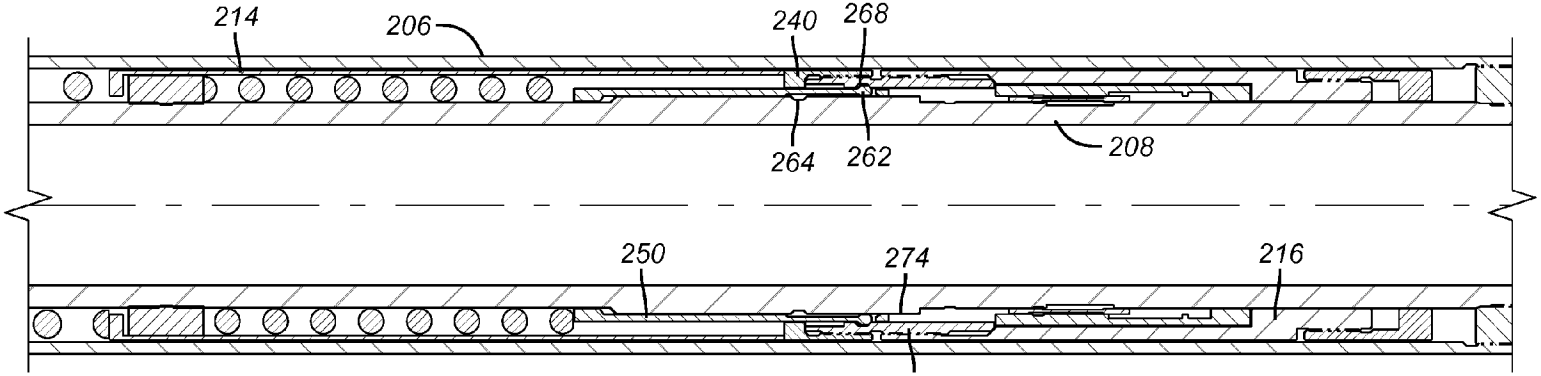

As the longer stroke occurs as described above and as better seen by comparing FIGS. 23 and 26 the first thing that happens is that groove 268 presents itself opposite heads 262 to allow them to escape groove 264 in the indexing mandrel 208 and stay in a locked position in grove 268 because outer surface of indexing mandrel 208 locks the heads 262 to groove 268. As a result the force in booster spring 256 can move the lock key housing 250 in tandem with the spring guide coupler 242, the housing 216 and the piston 222 shown fully extended in FIG. 24*b*. At the same time, the indexing spring 210 pushes on spring guide extension 214 and spring guide 240 and into the spring guide coupler 242 and from there the path to the piston 222 is the same as for the booster spring 256 just described. At the beginning of the stroke of the piston 222 there is a compounding of force from both springs 210 and booster spring 256 to turn for example a ball on a barrier valve (not shown) toward an open position against a large differential pressure in the same manner as described in the previous embodiment of FIGS. 1-17, with the main differences being that the tool T' is resettable when a mechanically operated valve (not shown) is closed with a tool (not shown) that is inserted in passage 200 to retract the piston 222 to the FIG. 18*c* position. Another difference between the embodiments is that the piston goes up and down with every application and removal of pressure whereas the previous embodiment locks the pushrods 110 until the dogs 100 are released for the operating of the barrier tool to open or to operate another tool (not shown).

Those skilled in the art will appreciate that either embodiment allows the provision of a boost force for initial movement of a final controlled element such as a ball on a barrier valve where a hydraulic opening feature is desired. When trying to open a valve against high pressure differential pressure an extra amount of force is frequently needed. A force in the order of thousands of pounds or more may sometimes be required. The high differential pressure can cause some ball distortion and the accumulation of debris near the ball that has been closed for a long period of time can also add to the initial force required to start the ball turning. The large force may only need to be applied until the final controlled element opens slightly to equalize the pressure differential in the tubing. The variations described can be modular to fit against an operator of a mechanically operated valve or they can be integral with the valve assembly and be provided as a unit.

The number of pressure applications and releases before the final controlled element is operated can be arbitrarily set at fewer or more than 11 cycles, with the recitation of the 11 cycles being arbitrary. The degree of movement of the components in each cycle before operation of the final controlled element can also be varied, with the showing in the two disclosed embodiments of equal movement in each of the 11 cycles also being arbitrary.

In the embodiment of FIGS. 1-17 the final controlled element can preferably be in continuous or alternatively in no contact with the push rods 110 during the cycles where the push rods 110 are in a locked position. This can be an adjustment of the adjusting screw 112. The other embodiment that features one or more pistons 222 that move during the 11 cycles will at times be out of contact with the final controlled element or its actuator by design. However, that design provides a tradeoff of being resettable whereas the design of FIGS. 1-17 is not resettable.

While a stack of Belleville washers 88 or a coiled booster spring 256 are illustrated for examples, other types of devices for storing and selectively releasing potential energy force are contemplated included selective release of compressed fluids, wave springs or equivalents. While a boost force is preferably offered for the initial actuation of the final controlled element, the boost force device can be configured for extending the duration of the boost for a greater time of operation of the final controlled element and even for the full stroke length of the tool T or T'.

The isolation of the boost force delivery device during the cycling of the tool T or T' until the actuation is desired for the final controlled element removes the need to compress the washers 88 or the spring 256 on each pressure application. This allows the use of a smaller piston area in a tool where space is at a premium and additional pistons also can affect the pressure rating of the housing in which such pistons are disposed. However, in some applications there can be room for more pistons or pushrods to actually move the final controlled element and such alternatives are contemplated as well as the employment of an annular piston instead of one or more rod pistons.

The above description is illustrative of the preferred embodiment and many modifications may be made by those skilled in the art without departing from the invention whose scope is to be determined from the literal and equivalent scope of the claims below.

We claim:

1. An actuation assembly for a subterranean tool, comprising:

a housing;

an actuating member selectively extendable from said housing to operate the subterranean tool;

an indexing assembly comprising a counter mechanism cyclically movable by a pressure cycle of pressure application and pressure removal in said housing, a first biasing member opposing movement of said indexing assembly due to said pressure application;

said indexing assembly movable for a predetermined number of said pressure cycles without operating the subterranean tool;

a boost force device retaining a predetermined mechanical potential force independent of pressure in said housing wherein said mechanical potential force is not applied to said actuating member during said predetermined number of pressure cycles; and wherein said mechanical potential force is delivered to said actuating member when said counter mechanism has had an incremental cycle beyond said predetermined number of pressure cycles thereby extending said actuating member from said housing.

2. The assembly of claim 1, wherein:

said boost force device comprises a second biasing member retained by a lock that is defeated by movement of said indexing assembly during said incremental cycle.

3. The assembly of claim 2, wherein:

said second biasing member initially locked to said housing and subsequently locked to said indexing assembly upon movement of said indexing assembly during said incremental cycle.

4. The assembly of claim 3, wherein:

said first biasing member in said indexing assembly comprising an indexing spring, said indexing spring and said second biasing member providing an initial tandem force to said actuating member during said incremental cycle.

5. The assembly of claim 4, wherein:

said indexing spring continues to apply a force to said actuating member after said second biasing member has relaxed.

6. The assembly of claim 4, wherein:

said actuating member is selectively locked to said housing during said predetermined number of cycles.

7. The assembly of claim 6, wherein:

said movement of said indexing assembly that locks said second biasing member to said indexing assembly also unlocking said actuating member from said housing.

8. The assembly of claim 7, wherein:

said second biasing member is locked to said indexing assembly before said actuating member is released from said housing.

9. The assembly of claim 4, wherein:

said actuating member can be moved only once by said assembly at a subterranean location.

10. The assembly of claim 4, wherein said assembly further comprises:

an indexing member having a first side in pressure communication with a passage in an annulus in said housing and a second side in communication with an exterior of said housing.

11. The assembly of claim 10, wherein:

said first side access from said passage is through an incompressible or slightly compressible fluid filled chamber that is isolated from said passage with a floating piston.

12. The assembly of claim 11, wherein:

said floating piston is accessed from a port in said passage that is disposed on the opposite side of said indexing piston than said actuating piston.

13. The assembly of claim 4, wherein:

said second biasing member comprises a stack of Belleville washers.

14. The assembly of claim 4, wherein:

said pressure application of said cycles occurs on a lower end of an actuating piston of said indexing assembly that is exposed to a passage in said housing.

15. The assembly of claim 4, wherein:

said biasing member comprises a coiled spring.

16. The assembly of claim 4, wherein:

the subterranean tool comprises a barrier ball valve.

17. An actuation assembly for a subterranean tool, comprising:

a housing;

an actuating member selectively extendable from said housing to operate the subterranean tool;

an indexing assembly comprising a counter mechanism cyclically movable by a pressure cycle of pressure application and pressure removal in said housing, a bias opposing movement of said indexing assembly due to said pressure application;

said indexing assembly movable for a predetermined number of said pressure cycles without operating the subterranean tool;

a boost force device retaining a potential force during said predetermined number of said pressure cycles and delivering said potential force to said actuating member when said counter mechanism has had an incremental cycle beyond said predetermined number of said pressure cycles;

said bias in said indexing assembly comprising an indexing spring, said indexing spring and said biasing member providing an initial tandem force to said actuating member during said incremental cycle;

said actuating member reciprocates axially during said predetermined cycles.

18. The assembly of claim 17, wherein:

said actuating member remains in a bore in said housing while reciprocating during said predetermined cycles.

19. The assembly of claim 18, wherein:

said actuating member moves a longer distance during said incremental cycle than during said predetermined cycles;

said actuating member is resettable to within said bore whereupon another predetermined set of cycles and an incremental cycle are again required to extend said actuating member from said bore.

20. An actuation assembly for a subterranean tool, comprising:

a housing;

an actuating member selectively extendable from said housing to operate the subterranean tool;

an indexing assembly comprising a counter mechanism cyclically movable by a pressure cycle of pressure application and pressure removal in said housing, a bias opposing movement of said indexing assembly due to said pressure application;

said indexing assembly movable for a predetermined number of said pressure cycles without operating the subterranean tool;

a boost force device retaining a potential force during said predetermined number of said pressure cycles and delivering said potential force to said actuating member when said counter mechanism has had an incremental cycle beyond said predetermined number of said pressure cycles;

said bias in said indexing assembly comprising an indexing spring, said indexing spring and said biasing member providing an initial tandem force to said actuating member during said incremental cycle;

said indexing assembly further comprises an indexing sleeve having a pin to track a j-slot on said housing and a lock key extending in a housing groove to define opposed travel stops for said indexing sleeve;

said indexing sleeve rotating while reciprocating and carrying with said indexing sleeve a ramp sleeve during said predetermined cycles;

said indexing sleeve releasing said ramp sleeve during said incremental cycle to allow said ramp sleeve to push said lock key from said housing groove as said j-slot allows said indexing sleeve to travel a longer distance than during said predetermined cycles for actuation of the subterranean tool.

* * * * *